US008062115B2

(12) United States Patent
Thomas et al.

(10) Patent No.: US 8,062,115 B2
(45) Date of Patent: Nov. 22, 2011

(54) WAGERING GAME WITH MULTI-POINT GESTURE SENSING DEVICE

(75) Inventors: Alfred Thomas, Las Vegas, NV (US); Jorge L. Shimabukuro, Las Vegas, NV (US); Anthony Prohl, Romeoville, IL (US)

(73) Assignee: WMS Gaming Inc., Waukegan, IL (US)

( * ) Notice: Subject to any disclaimer, the term of this patent is extended or adjusted under 35 U.S.C. 154(b) by 260 days.

(21) Appl. No.: 12/226,197

(22) PCT Filed: Apr. 26, 2007

(86) PCT No.: PCT/US2007/010048

§ 371 (c)(1),
(2), (4) Date: Oct. 10, 2008

(87) PCT Pub. No.: WO2007/127258

PCT Pub. Date: Nov. 8, 2007

(65) Prior Publication Data

US 2009/0191946 A1 Jul. 30, 2009

Related U.S. Application Data

(60) Provisional application No. 60/795,421, filed on Apr. 27, 2006.

(51) Int. Cl.
*A63F 9/24* (2006.01)

(52) U.S. Cl. ..... 463/16; 463/30; 463/31

(58) Field of Classification Search ..... 463/16, 463/20, 30, 31

See application file for complete search history.

(56) References Cited

U.S. PATENT DOCUMENTS

| | | | |
|---|---|---|---|
| 3,533,628 | A | 10/1970 | Fisher |
| 4,357,488 | A | 11/1982 | Knighton et al. |
| 4,484,179 | A | 11/1984 | Kasday |
| 4,522,399 | A | 6/1985 | Nishikawa |
| 4,715,004 | A | 12/1987 | Kabasawa et al. |

(Continued)

FOREIGN PATENT DOCUMENTS

AU 199943487 A1 3/2000

(Continued)

OTHER PUBLICATIONS

Hand Tracking, Finger Identification, and Chordic Manipulation on a Multi-Touch Surface, by Wayne Westerman; 363 pages (Spring 1999).

(Continued)

*Primary Examiner* — Omkar Deodhar
(74) *Attorney, Agent, or Firm* — Nixon Peabody LLP

(57) ABSTRACT

A gaming machine having a multipoint sensing device capable of sensing a multipoint gesture, which includes at least two simultaneously touched points. One or both of the points can serve as an initial starting point for a gesture, which represents a continuous movement across the multipoint sensing device. The multipoint sensing device produces data representing a multipoint gesture, which data is analyzed to determine a wagering-game function to be executed. For example, the wagering-game function may be selecting a payline by touching two distinct points in a slot-type wagering game. Another function may be increasing a bonus award by dragging two fingers in opposite directions. Yet another function may be selecting a bonus award amount by holding one finger while dragging another finger to aim at a target representing multiple bonus award amounts, one of those amounts being revealed to the player upon release of the other finger.

38 Claims, 15 Drawing Sheets

U.S. PATENT DOCUMENTS 4,746,770 A 5/1988 McAvinney
4,763,278 A 8/1988 Rajasekaran et al.
4,844,475 A 7/1989 Saffer et al.
4,856,787 A * 8/1989 Itkis ..... 273/237
4,968,877 A 11/1990 McAvinney et al.
5,133,017 A 7/1992 Cain et al.
5,186,460 A 2/1993 Fongeallaz et al.
5,214,414 A * 5/1993 Levine et al. ..... 345/157
5,259,613 A 11/1993 Marnell, II
5,318,298 A 6/1994 Kelly et al.
5,370,399 A 12/1994 Liverance
5,444,786 A 8/1995 Raviv
5,469,193 A 11/1995 Giobbi et al.
5,469,510 A 11/1995 Blind et al.
5,511,148 A 4/1996 Wellner
5,524,888 A 6/1996 Heidel
5,533,727 A 7/1996 DeMar
5,542,669 A 8/1996 Charron et al.
5,589,856 A 12/1996 Stein et al.
5,655,961 A 8/1997 Acres et al.
5,695,188 A 12/1997 Ishibashi
5,704,836 A 1/1998 Norton et al.
5,743,798 A 4/1998 Adams et al.
5,762,552 A 6/1998 Vuong et al.
5,770,533 A 6/1998 Franchi
5,775,993 A 7/1998 Fentz et al.
5,803,810 A 9/1998 Norton et al.
5,807,177 A 9/1998 Takemoto et al.
5,808,567 A 9/1998 McCloud
5,816,918 A 10/1998 Kelly et al.
5,825,352 A * 10/1998 Bisset et al. ..... 345/173
5,828,768 A 10/1998 Eatwell et al.
5,833,538 A 11/1998 Weiss
5,851,148 A 12/1998 Brune et al.
5,896,126 A 4/1999 Shieh
5,941,773 A 8/1999 Harlick
5,943,043 A 8/1999 Furuhata et al.
5,946,658 A 8/1999 Miyazawa et al.
5,971,850 A 10/1999 Liverance
5,976,019 A 11/1999 Ikeda et al.
6,024,640 A * 2/2000 Walker et al. ..... 463/17
6,067,112 A 5/2000 Wellner et al.
6,068,552 A 5/2000 Walker et al.
6,089,663 A 7/2000 Hill
6,110,041 A 8/2000 Walker et al.
6,159,097 A * 12/2000 Gura ..... 463/20
6,162,121 A 12/2000 Morro et al.
6,210,167 B1 4/2001 Nishiyama
6,217,448 B1 4/2001 Olsen
6,246,395 B1 6/2001 Goyins et al.
6,254,483 B1 7/2001 Acres
6,255,604 B1 7/2001 Tokioka et al.
6,283,860 B1 9/2001 Lyons et al.
6,302,790 B1 10/2001 Brossard
6,308,953 B1 10/2001 Nagano
6,315,666 B1 11/2001 Mastera et al.
6,416,411 B1 7/2002 Tsukahara
6,422,941 B1 7/2002 Thorner et al.
6,471,589 B1 10/2002 Nagano
6,530,842 B1 3/2003 Wells et al.
6,561,908 B1 5/2003 Hoke
6,607,443 B1 8/2003 Miyamoto et al.
6,620,045 B2 9/2003 Berman et al.
6,638,169 B2 10/2003 Wilder et al.
6,642,917 B1 11/2003 Koyama et al.
6,676,514 B1 1/2004 Kusuda et al.
6,677,932 B1 1/2004 Westerman
6,757,002 B1 * 6/2004 Oross et al. ..... 715/864
6,767,282 B2 7/2004 Matsuyama et al.
6,788,295 B1 9/2004 Inkster
6,819,312 B2 11/2004 Fish
6,856,259 B1 2/2005 Sharp
6,929,543 B1 8/2005 Ueshima et al.
6,932,706 B1 8/2005 Kaminkow
6,942,571 B1 9/2005 McAllister et al.
6,995,752 B2 2/2006 Lu
7,077,009 B2 7/2006 Lokhorst et al.
7,204,428 B2 4/2007 Wilson
7,254,775 B2 8/2007 Geaghan et al.
RE40,153 E 3/2008 Westerman et al.
7,379,562 B2 5/2008 Wilson
7,397,464 B1 7/2008 Robbins et al.
7,411,575 B2 8/2008 Hill et al.
7,479,065 B1 1/2009 McAllister et al.
7,479,949 B2 1/2009 Jobs et al.
2002/0003919 A1 1/2002 Morimoto
2002/0013173 A1 1/2002 Walker et al.
2002/0037763 A1 3/2002 Idaka
2002/0090990 A1 7/2002 Joshi et al.
2002/0142825 A1 10/2002 Lark et al.
2002/0142846 A1 10/2002 Paulsen
2002/0151349 A1 10/2002 Joshi
2003/0054881 A1 3/2003 Hedrick et al.
2003/0067447 A1 4/2003 Geaghan et al.
2003/0114214 A1 6/2003 Barahona et al.
2004/0001048 A1 1/2004 Kraus et al.
2004/0029637 A1 2/2004 Hein, Jr. et al.
2004/0166930 A1 * 8/2004 Beaulieu et al. ..... 463/25
2004/0166937 A1 8/2004 Rothschild et al.
2005/0227217 A1 10/2005 Wilson
2005/0259378 A1 11/2005 Hill et al.
2006/0001652 A1 1/2006 Chiu et al.
2006/0010400 A1 1/2006 Dehlin et al.
2006/0025194 A1 2/2006 McInerny et al.
2006/0026521 A1 * 2/2006 Hotelling et al. ..... 715/702
2006/0026536 A1 2/2006 Hotelling et al.
2006/0031786 A1 2/2006 Hillis et al.
2006/0033724 A1 2/2006 Chaudhri et al.
2006/0073891 A1 4/2006 Holt
2006/0101354 A1 5/2006 Hashimoto et al.
2006/0164399 A1 7/2006 Cheston et al.
2006/0284874 A1 12/2006 Wilson
2006/0294247 A1 12/2006 Hinckley et al.
2007/0124370 A1 5/2007 Nareddy et al.
2007/0152984 A1 7/2007 Ording et al.
2007/0177803 A1 8/2007 Elias et al.
2007/0201863 A1 8/2007 Wilson et al.
2007/0247435 A1 10/2007 Benko et al.
2008/0158145 A1 7/2008 Westerman
2008/0158146 A1 7/2008 Westerman
2008/0158147 A1 7/2008 Westerman et al.
2008/0158168 A1 7/2008 Westerman et al.
2008/0158169 A1 7/2008 O'Connor et al.
2008/0158174 A1 7/2008 Land et al.
2008/0163130 A1 7/2008 Westerman
2008/0180654 A1 7/2008 Bathiche et al.
2008/0211766 A1 9/2008 Westerman et al.
2008/0231611 A1 9/2008 Bathiche et al.
2008/0309631 A1 12/2008 Westerman et al.
2008/0309634 A1 12/2008 Hotelling et al.
2009/0002327 A1 1/2009 Wilson et al.
2009/0002344 A1 1/2009 Wilson et al.
2009/0021489 A1 1/2009 Westerman et al.

FOREIGN PATENT DOCUMENTS

EP 309946 4/1989
JP 1269120 A 10/1989
JP 5-31254 2/1993
JP 8083144 A 3/1996
JP 8190453 A 7/1996
JP 8241161 A 9/1996
JP 10-277213 10/1998
JP 2000/010733 A 1/2000
WO WO/97/30416 8/1997
WO WO/99/19855 4/1999
WO WO 01/05477 1/2001
WO WO 01/33905 5/2001
WO WO 02/24288 3/2002
WO WO 02/40921 5/2002
WO WO/2006/020305 2/2006
WO WO/2008/095132 10/2008
WO WO/2008/017077 12/2008

OTHER PUBLICATIONS

A Multi-Touch Three Dimensional Touch-Sensitive Tablet; CHI'85 Proceedings; pp. 21-25 (Apr. 1985).

The Sensor Frame Graphic Manipulator Final Report (Sensor Frame) 27 pages; (printed on Feb. 6, 2009).
The Design of a GUI Paradigm based on Tablets, Two-Hands, and Transparency; Gordon Kurtenbach, George Fitmaurice, Thomas Baudel, and Bill Buxton; 8 pages; (printed on Feb. 6, 2009).
SmartSkin: An Infrastructure for Freehand Manipulation on Interactive Surfaces, by Jun Rekimoto, Interaction Laboratory; 8 pages; (printed on Feb. 6, 2009).
Single-Handed Interction Techniques for Multiple Pressure-Sensitive Strips by Gábor Blaskó, Steven Feiner; 4 pages; (printed on Feb. 6, 2009).
A Multi-finger Interface for Performance Animation of Deformable Drawings; Tomer Moscovich, Takeo Igarashi, Jun Rekimoto, Kentaro Fukuchi, John F. Hughes; 2 pages; (printed on Feb. 6, 2009).
Precise Selection Techniques for Multi-Touch Screens; Hrvoje Benko and Andrew D. Wilson and Patrick Baudisch; 10 pages; (printed on Feb. 6, 2009).
ThinSight: Versatile Multi-touch Sensing for Thin Form-factor Displays; Steve Hodges, Shahram Izadi, Alex Butler, Alban Rrustemi and Bill Buxton; 10 pages; (printed on Feb. 6, 2009).
Weinert, Joe, Entertainment Vehicles, IGWB New '97 Games, pp. 11, 12 and 15-18 (Mar. 1997).
Written Opinion corresponding to co-pending International Patent Application Serial No. PCT/US2007/010048, United States Patent Office, dated Jun. 10, 2008, 3 pages.
International Search Report corresponding to co-pending International Patent Application Serial No. PCT/US2007/010048, United States Patent Office, dated Jun. 10, 2008, 2 pages.
http://www.mrl.nyu.edu/~jhan/ftirsense/index.html; 2 pages, (downloaded Oct. 7, 2008).
http://ds.advancedmn.com/article.php?artid=3395;3 pages (downloaded Oct. 7, 2008).
http://us.gizmodo.com/gadgets/portable-media/apple-touchscreen-patent-documentation-154248.php; 11 pages (downloaded Oct. 7, 2008).
http://loop.worldofapple.com/archives/2006/02/08/multi-touch-interaction-video/; 19 pages, (downloaded Oct. 7, 2008).
http://www.pcmag.com/article2/0,1895,1918674,00.asp; 4 pages, (downloaded Oct. 7, 2008).

* cited by examiner

300

WAGERING GAME WITH MULTI-POINT GESTURE SENSING DEVICE

CROSS-REFERENCE TO RELATED APPLICATIONS

This application is a U.S. National Stage of International Application No. PCT/US2007/010048, filed Apr. 26, 2007, which claims the benefit of U.S. Provisional Application No. 60/795,421, filed on Apr. 27, 2006, both of which are incorporated herein by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to wagering games, and more particularly, to a wagering game with a multi-point gesture sensing device.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

Gaming machines have also utilized a variety of input devices for receiving input from a player, such as buttons and touch screen devices. However, these input devices are limited in that they can receive only one input at a time from the player. For example, if a player touches a singlepoint sensing device such as a singlepoint touch screen device at two distinct points simultaneously, only one coordinate is provided by the touch screen driver corresponding to one of the distinct points only or to a single average point between the two points. The inability of the player to interact with the gaming machine by providing multiple inputs simultaneously is a significant disadvantage to gaming machines heretofore.

Thus, a need exists for an improved apparatus and method. The present invention is directed to satisfying one or more of these needs and solving other problems.

SUMMARY OF THE INVENTION

According to one aspect of the present invention, a gaming machine, which may be handheld, includes an input device for receiving a signal representing a wager associated with a wagering game (which may be a bonus game), a video display, which may be of the liquid crystal type, for displaying the wagering game and a randomly selected outcome thereof, a multipoint sensing device positioned adjacent to the video display and having an output for outputting multipoint input data indicative of a multipoint input relative to the video display such that the multipoint input corresponds to at least two distinct contact points sensed simultaneously by the multipoint sensing device, and a controller coupled to the multipoint sensing device and the video display, the controller being programmed to execute a predetermined wagering-game function associated with said multipoint input data and to cause the video display to display at least one graphic as the at least two distinct contact points are sensed by the multipoint sensing device.

In an aspect, the multipoint sensing device may include a frustrated total internal reflection (FTIR) device having a transparent substrate, the video display including a projector for displaying images relative to the transparent substrate and a video camera for capturing scattered light at multiple points of contact on the transparent pane. In another aspect, the multipoint sensing device is a multipoint touch screen that includes a plurality of capacitive electrodes arrayed relative to a transparent substrate, the multipoint touch screen overlaying at least a portion of the display.

In various aspects, the predetermined wagering-game function may include a selection of a payline, an amount to wager per payline, a selection of a bonus award amount that may be revealed to the player as a function of the respective coordinates of the touched point and the released point, a selection of a plurality of keno numbers or roulette numbers, or a request to hold multiple cards of the wagering game. The controller may be further programmed to cause the video display to display a motion trail with the multipoint input sensed by the multipoint sensing device.

The multipoint input may include a gesture, and the multipoint input data may be indicative of any one or more of a direction, a size, a velocity, an acceleration, and a pressure of the gesture sensed by the multipoint sensing device. The multipoint input may correspond to a point that is touched relative to the multipoint sensing device and held there while touching another point, dragging that other point relative to the multipoint sensing device, and releasing that other point.

According to another aspect, a method of conducting a wagering game on a gaming machine includes receiving a signal representing a wager associated with a wagering game, displaying on a video display of the gaming machine a randomly selected outcome of the wagering game, identifying at least one multipoint gesture based on data received from a multipoint sensing device, and responsive to the identifying, modifying signals in the gaming machine and displaying on the video display one or more graphics as each point is sensed by the multipoint sensing device. The modifying signals may include causing a controller of the gaming machine to determine, responsive to the identifying, a wagering-game function and to execute the wagering-game function.

The method may further include comparing the data with data representing a wagering-game function, the modifying including executing the wagering-game function responsive to the comparing. The at least one multipoint gesture may include at least two distinct points touched simultaneously on the multipoint sensing device, at least two gestures moved simultaneously relative to the multipoint sensing device and having two distinct initial touch points, or at least a first touch point held relative to the multipoint sensing device while simultaneously at least a second touch point, distinct from the first touch point, is gestured relative to the multipoint sensing device.

The displaying may further include displaying an animation synchronized with the at least one multipoint gesture sensed by the multipoint sensing device. The method may further include determining any one or more of a direction, velocity, acceleration, and pressure associated with the at least one multipoint gesture, and responsive thereto, causing a wagering-game function to be executed.

Responsive to the identifying, the method may further include associating a selection of a payline with the at least one multipoint gesture, a number of wagers per payline with the at least one multipoint gesture, a selection of a bonus award amount with the at least one multipoint gesture, or a selection of multiple cards with the at least one multipoint gesture. In an aspect, a computer readable storage medium is encoded with instructions for directing a handheld gaming machine to carry out any of the methods described herein.

According to another aspect of the present invention, a method of conducting a wagering game on a gaming machine includes receiving a signal indicative of a wager input for a wagering game, displaying on the gaming machine a randomly selected outcome of the wagering game, receiving data from a multipoint sensing device indicative of at least one multipoint gesture, the multipoint gesture including at least two points simultaneously touched relative to the multipoint sensing device, comparing said data with representative ones of a plurality of predetermined multipoint gesture inputs, each predetermined input corresponding to a representative player input, associating each player input with a corresponding function related to the wagering game, executing the function associated with the player input corresponding to the predetermined multipoint gesture input, and displaying a graphic that is correlated with the at least one multipoint gesture. The multipoint gesture includes at least one gesture originating at one of the at least two points.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
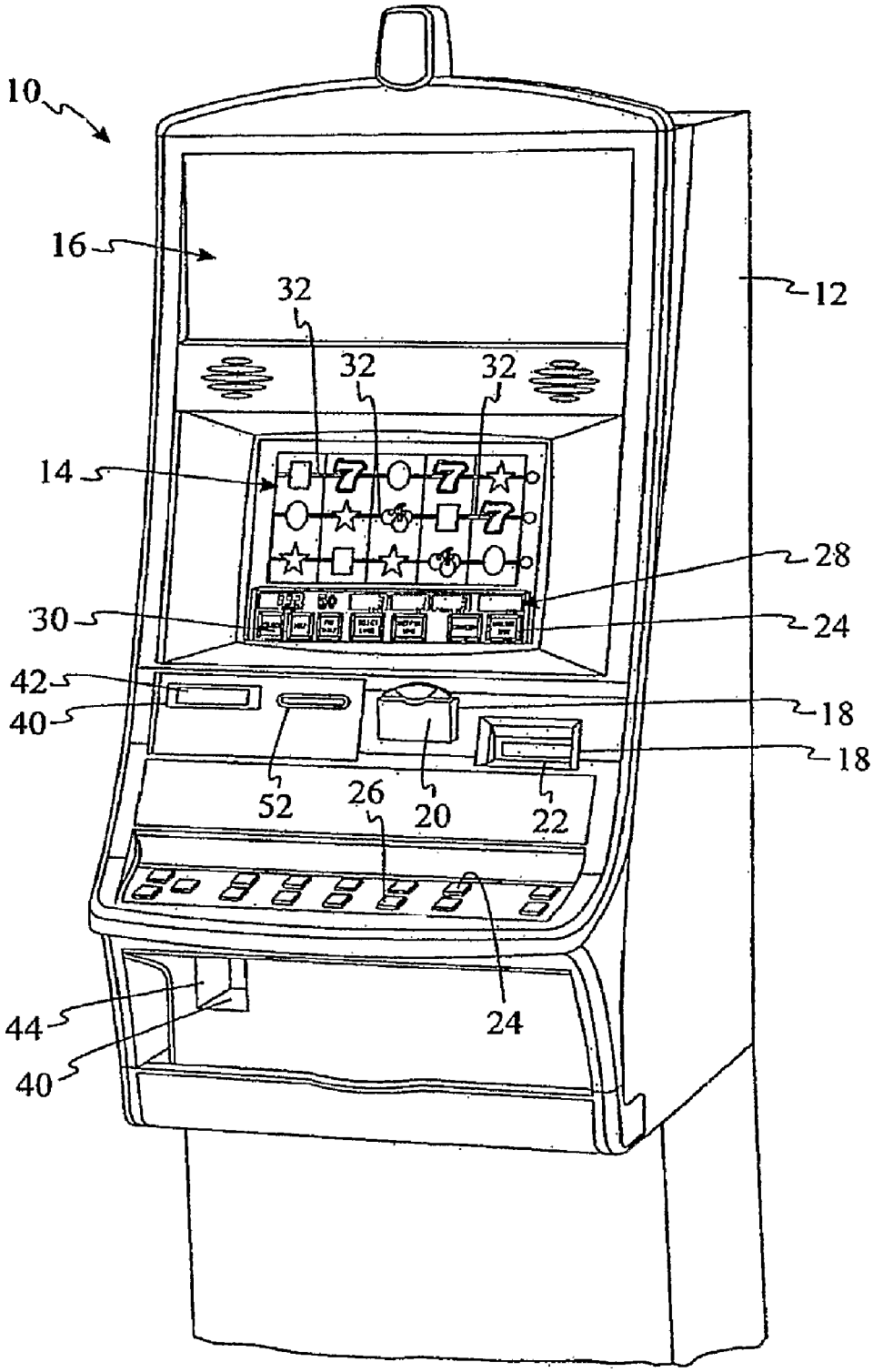
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable. storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
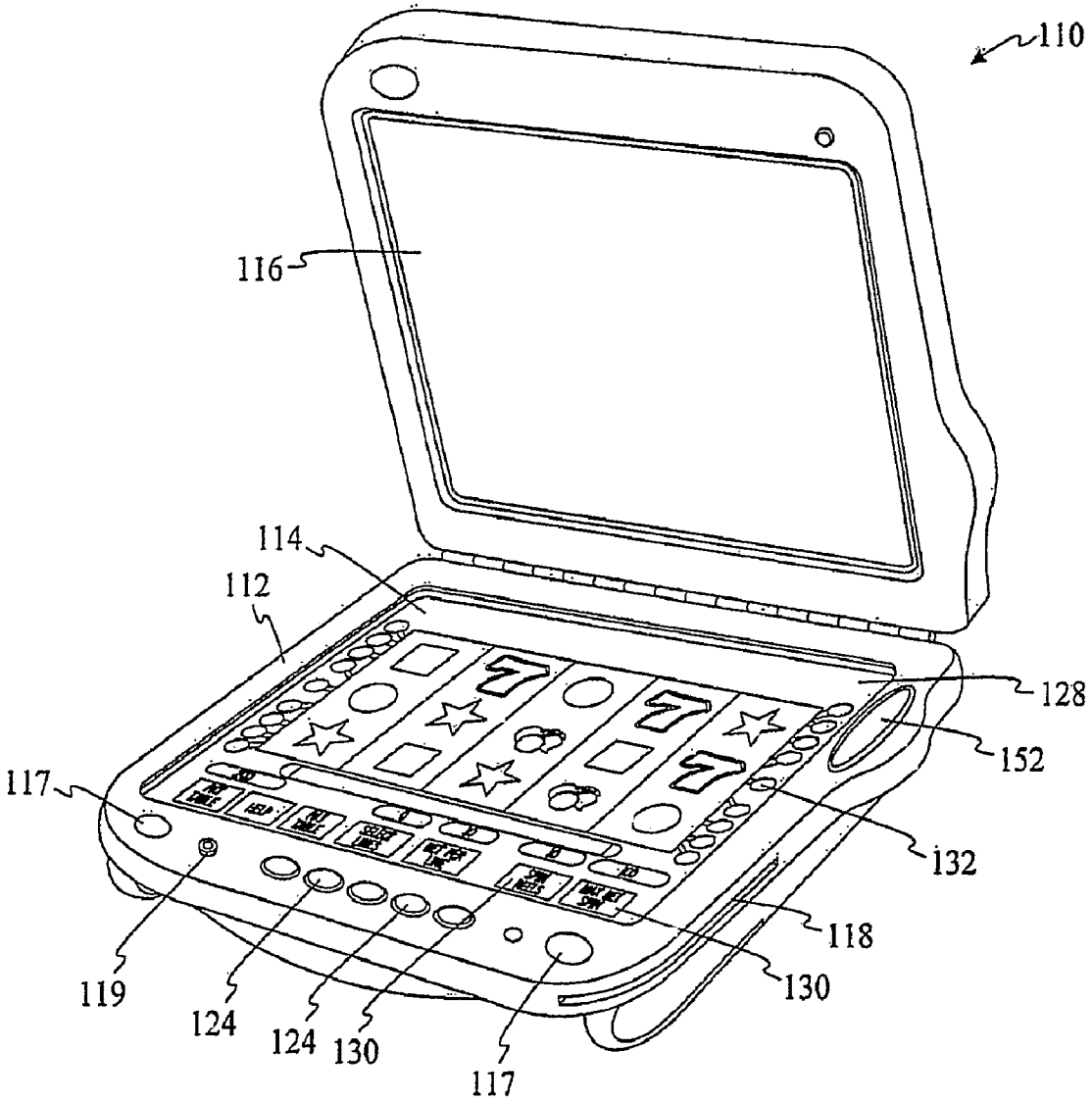
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons 126 on a button panel for operating the handheld gaming machine 110. In addition, or alternatively, the player input device 124 may comprise a touch screen mounted to a primary display 114 and/or secondary display 116. In one aspect, the touch screen is matched to a display screen having one or more selectable touch keys 130 selectable by a user's touching of the associated area of the screen using a finger or a tool, such as a stylus pointer. A player enables a desired function either by touching the touch screen at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 1741 display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 10. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1, comprises a biometric sensing device.

Figure 2:
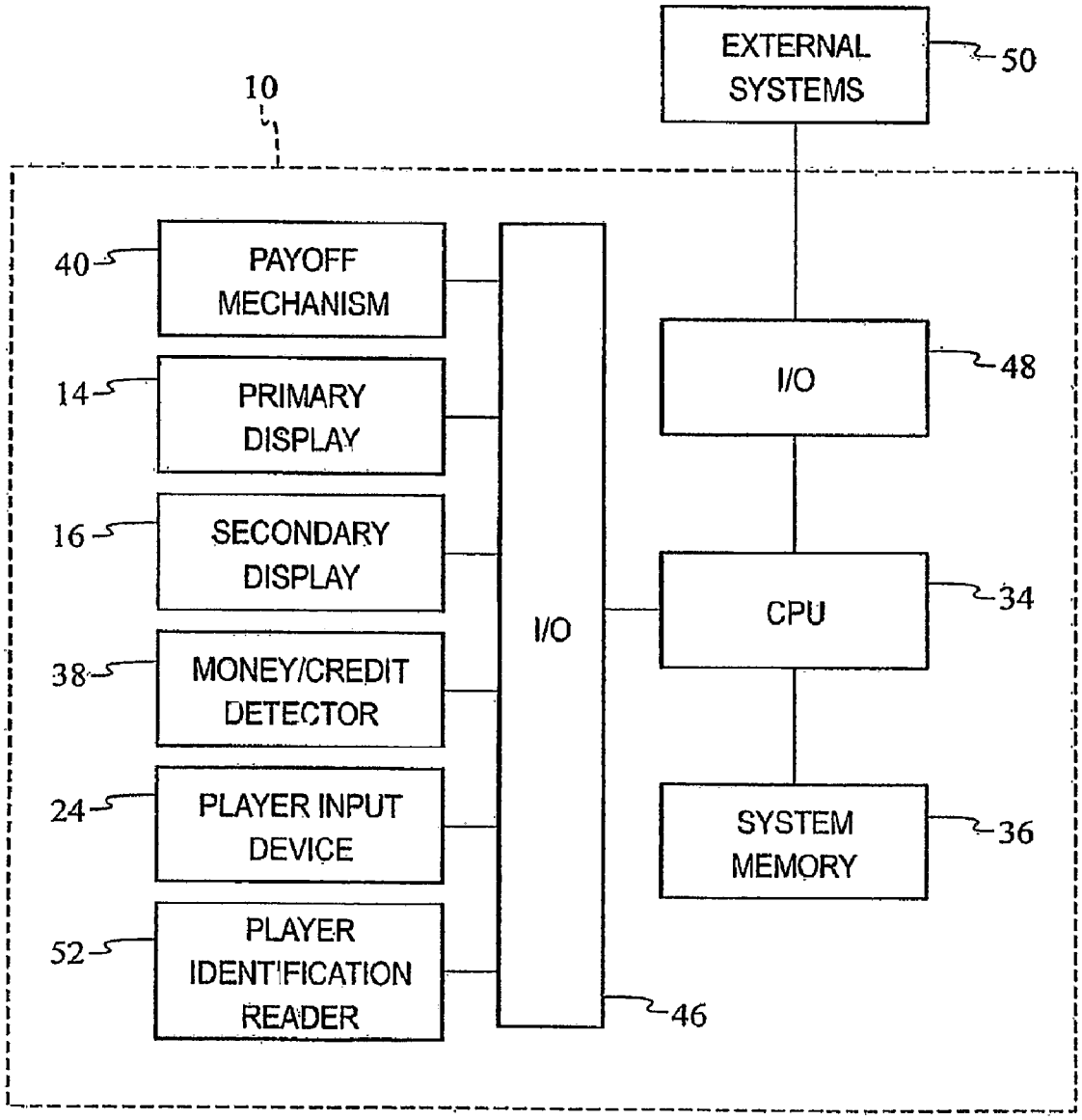
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10, 110 may communicate with external systems 50 (in a wired or wireless manner) such that each machine operates as a "thin client," having relatively less functionality, a "thick client," having relatively more functionality, or through any range of functionality therebetween. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
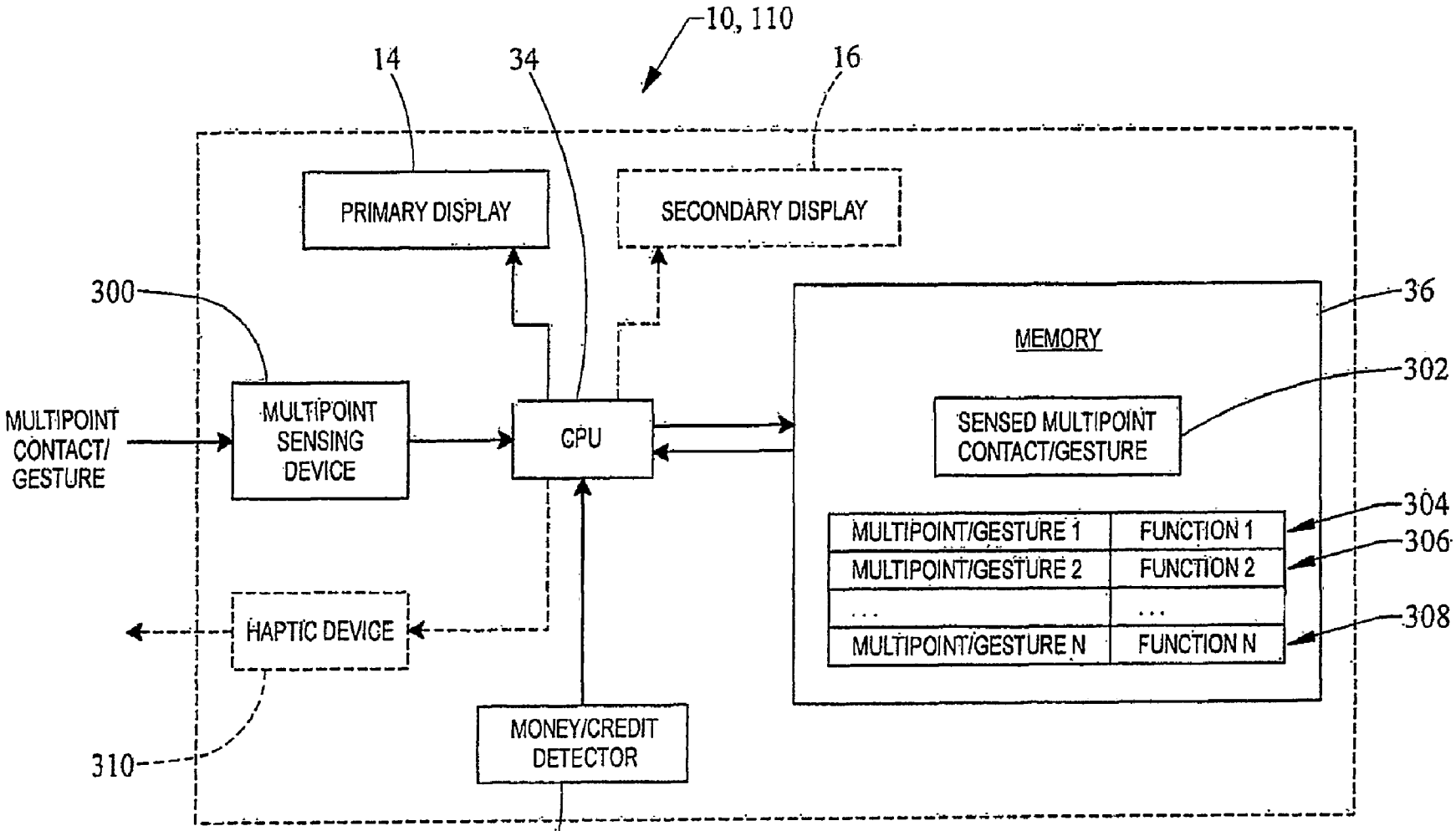
FIG. 3 is a functional block diagram of a gaming machine having a multipoint sensing device according to an aspect of the present invention.

Turning now to FIG. 3, a functional block diagram illustrating a gaming machine 10, 110 according to an embodiment of the present invention. The gaming machine 10, 110 includes a multipoint sensing device 300 that constitutes a human-machine interface (HMI) between a human player and the gaming machine 10, 110. The multipoint sensing device 300 is capable of detecting multiple points touched or nearly touched simultaneously on the multipoint sensing device 300, multipoint gestures while maintaining continuous contact with the multipoint sensing device 300, or a combination of one or more multiple points and multipoint gestures. As used herein, a multipoint gesture refers to multiple gestures that originate by contacting two or more points on the multipoint sensing device 300. Such gestures may be bimanual (i.e., require use of both hands to create a "chording" effect) or multi-digit (i.e., require use of two or more fingers as in rotation of a dial). Bimanual gestures may be made by the hands of a single player, or by different hands of different players, such as in a multi-player wagering game. An example of a multipoint gestures is shown and described in connection with FIGS. 9*a* and 9*b* below. By "simultaneously" it is meant that at some point in time, more than one point is touched. In other words, it is not necessary to touch two different points at the precise same moment in time. Rather, one point can be touched first, followed by a second point, so long as the first point remains touched as the second point is touched. In that sense, the first and second points are touched simultaneously. If contact is removed from the first point before the second touch is applied, then such a touch-scheme would be deemed to be a single-touch scheme.

The multipoint sensing device 300 outputs multipoint data representative of the multiple points touched or the multiple gestures. The multipoint data may include the coordinates of the points contacted or touched, the pressure of the points or areas touched, the directions of the gestures, the size (one finger, two fingers, etc., for example) of the areas touched, the velocity of the gestures, the acceleration of the gestures, or the length of time a point or area on the multipoint sensing device 300 was touched or a gesture lingered on the multipoint sensing device 300.

The system memory 36 may store data representing the multipoints touched or the multipoint gesture sensed in a memory location 302. Predetermined data corresponding to a first multipoint/gesture (i.e., a multipoint or a multipoint gesture) may be stored in a memory location 304, data corresponding to a second multipoint/gesture may be stored in a memory location 306, and an nth multipoint/gesture may be stored in a memory location 308. The sensed multipoint/gesture data 302 is compared against the predetermined data 304, 306, 308 to determine a function to execute by the CPU 34. Note that the data representing the sensed multipoint/gesture 302 and the predetermined data 304, 306, 308 may be stored in a memory separate from the system memory 36.

The multipoint sensing device 300 may be any suitable multipoint touchscreen capable of detecting or sensing multiple points touched simultaneously on the device 300 or multiple gestures gestured on the device 300. An example of a suitable multipoint sensing devices includes a multipoint touchscreen available from CAD Center Corp. under the trade designation "NEXTRAX™." This multipoint touchscreen is an optical-based that triangulates the touched coordinate(s) using infrared rays (retroreflective system) or an image sensor. Another example is a frustrated total internal reflection (FTIR) device, such as developed by the Media Research Laboratory at New York University's Department of Computer Science, and described in Jefferson Y. Han, Low-Cost Multi-Touch Sensing Through Frustrated Total Internal Reflection (Proceedings of the 18th Annual ACM Symposium on User Interface Software and Technology 2005), at 115-118. An FTIR device is shown and described in connection with FIG. 4. A still further example of a multipoint sensing device 300 is a transparent self-capacitance or mutual-capacitance touchscreen, such as described and shown in WO 2005/114369, entitled "Multipoint Touchscreen," which claims priority to U.S. patent application Ser. No. 10/840,862, and is assigned to Apple Computer, Inc. A self-capacitance touchscreen is shown and described in connection with FIG. 5.

The gaming machine 10, 110 may optionally include a haptic device 310. Examples of suitable haptic devices include a haptic touchscreen manufactured by Immersion Corporation of San Jose, Calif., under the trade designation TouchSense®, a linear or rotary voice-coil actuator, or one or more piezoelectric elements. The haptic device 310 produces vibrations that are perceived by the tactile sense of the player. These vibrations can be synchronized with the multipoint gesture to provide tactile feedback to the player. The tactile feedback creates a more realistic interactive gaming environment and can also provide assurance to the player that the multipoint gesture is being sensed properly.

Figure 4:
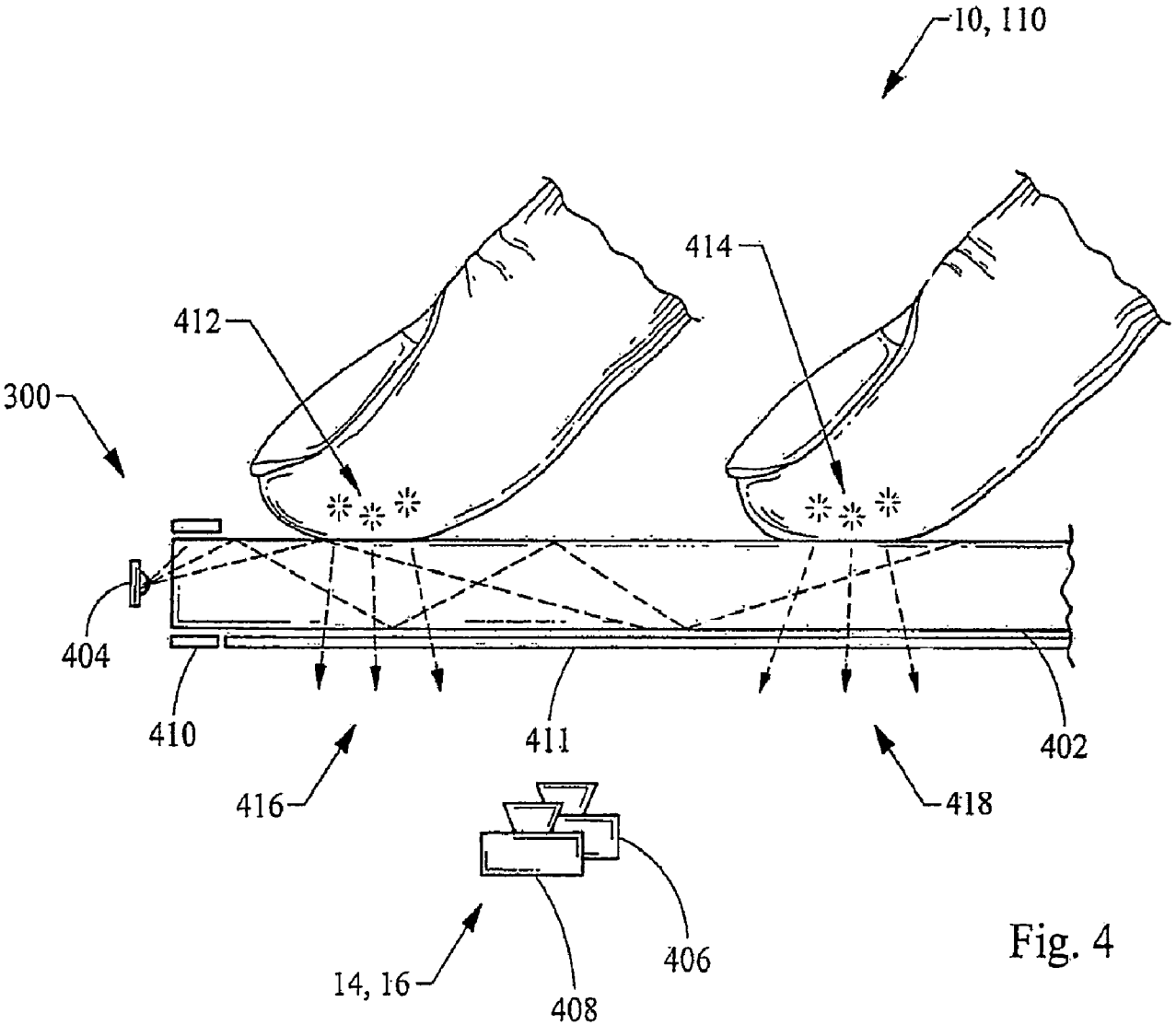
FIG. 4 is a functional illustration of a multipoint sensing device that utilizes a frustrated total internal reflection (FTIR) device according to a specific aspect of the present invention.

FIG. 4 is a functional illustration of the multipoint sensing device 300 configured as a frustrated total internal reflection (FTIR) device. The FTIR device 300 may be used in the gaming machine 10 or the handheld gaming machine 110. The FTIR device 300 includes a transparent substrate 402, preferably made of acrylic, an LED 404, a projector 406, a video camera 408, a baffle 410, and a diffuser 411 secured by the baffle 410. The projector 406 and the video camera 408 together comprise the primary or secondary display 14, 16 of the gaming machine 10, 110.

The transparent substrate 402 is edge-lit by the LED 404, which are high-power infrared LEDs placed directly against the polished edges of the transparent substrate 402. The video camera 408, preferably a digital one, includes a band-pass filter to isolate the infrared frequencies and is coupled to the CPU 34. The rear-projection projector 406 projects images onto the transparent substrate 402, which diffuses through the diffuser 411 and rendered visible. Pressure can be sensed by the FTIR device 300 by comparing the pixel area of the point touched. For example, a light touch will register a smaller pixel area by the video camera 408 than a heavy touch by the same finger tip.

The FTIR device 300 is capable of sensing or detecting multiple touches, such as the touches 412, 414. When fingers touch the points 412, 414 on the transparent substrate 402, the infrared light bouncing around inside the transparent substrate 402 is scattered in the general directions 416, 418, and these optical disturbances are picked up by the band-pass filter in the video camera 408. Gestures can also be recorded by the video camera 408, and data representing the multipoint gestures is transmitted to the CPU 34 for further processing. The data can include any one or more of the velocity, direction, acceleration, and pressure of a gesture.

Figure 5:
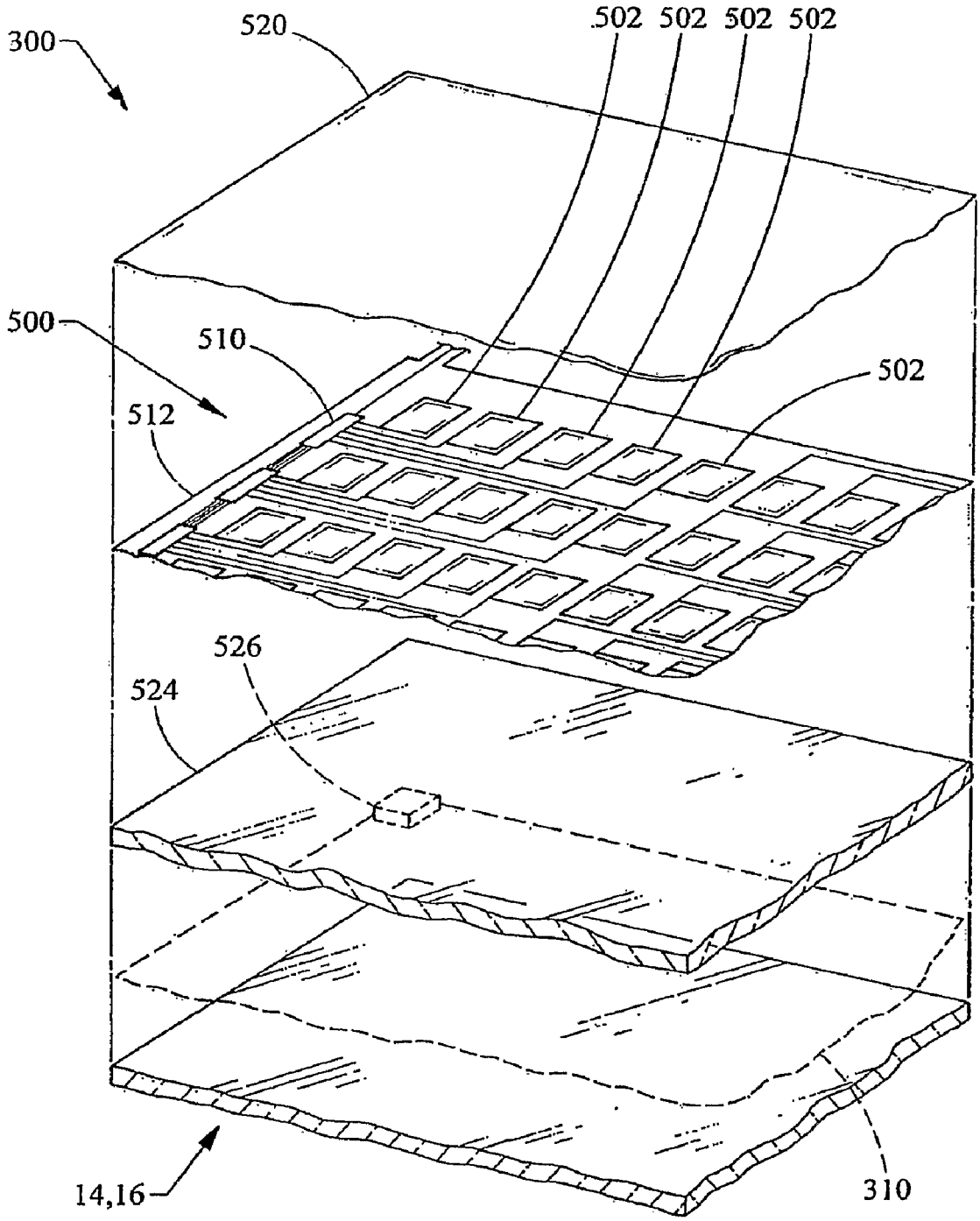
FIG. 5 is a functional illustration of a multipoint sensing device employing self-capacitance nodes according to another aspect of the present invention.

Another touchscreen device suitable for detecting multiple touches or multipoint gestures is shown in FIG. 5. The multipoint sensing device 300 includes a transparent touchscreen 500 that includes multiple transparent capacitive electrodes 502 arranged in an array across a surface of a transparent substrate 512. Sensor circuits 510 serially connected together measure the capacitance of each corresponding electrode 502 to which they are connected via miniscule traces that are at least semi-transparent or translucent. The electrodes 502 have a size and shape dimensioned to detect an average human finger tip. Each electrode 502 represents an individual capacitor, allowing multiple points or multipoint gestures to be detected simultaneously. In the illustrated embodiment, individual electrodes 502 measure their own capacitance independent of the other electrodes relative to ground. In another embodiment, the capacitance is measured between two or more electrodes, producing a higher "resolution" of touch-points as the electrodes can be made smaller and can overlap one another.

The touchscreen 500 is overlaid a transparent glass or plastic substrate 524, which together are overlaid the display 14, 16 and the optional haptic touchscreen 310, which includes actuating devices 526 (such as one near each corner of the haptic touchscreen 310) that are actuated according to a vibration profile in order to create a haptic effect. A protective transparent cover 520 is placed over the transparent substrate 512. Because the electrodes 502 are capacitive-sensing, touches on the protective cover 520 will cause a change in capacitance in the electrodes 502. The outputs of the sensor circuits 510 are coupled to a controller that processes data representing which electrodes 502 measured a change in capacitance. The magnitude of the change represents a pressure. A greater deviation in capacitance represents a greater pressure, and these deviations can be converted by an analog-to-digital converter into numbers representing an amount of pressure. The data can also represent a gesture where multiple electrodes 502 register a touch at various time intervals. The velocity, direction, and acceleration of the gesture can be represented in the data.

Other touch sensing technologies are suitable for use as the multipoint sensing device 300, including resistive sensing, surface acoustic wave sensing, pressure sensing, optical sensing, and the like.

Figure 6:
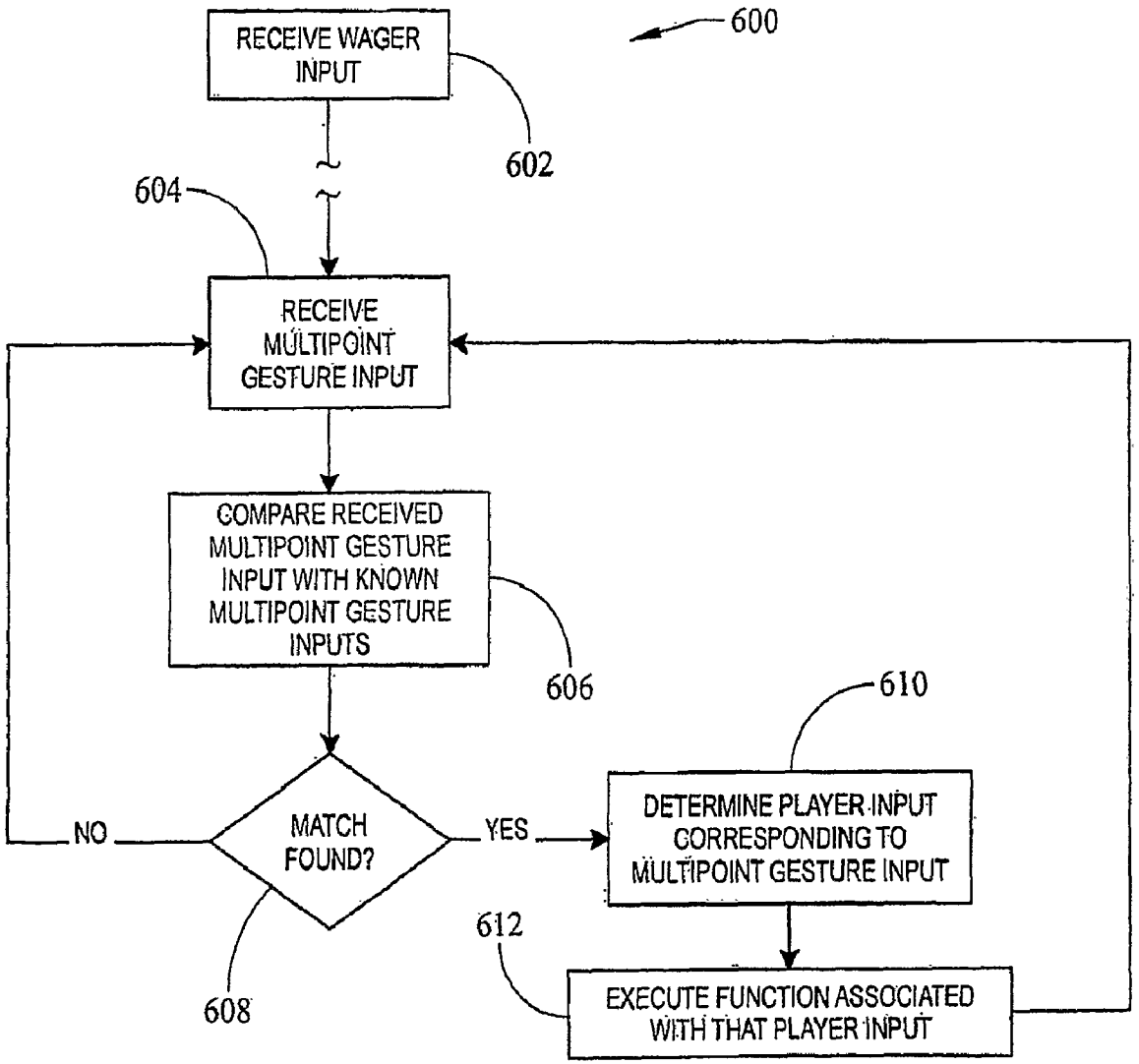
FIG. 6 is a flow chart depicting a method of sensing a multipoint gesture input according to an aspect of the present invention.

FIG. 6 is a flow chart diagram of a method (600) of carrying out an aspect of the present invention. A wager input is received (602) via, for example, the value input device 18 or a signal representing a wager, such as wager-input data wirelessly communicated between a portable data unit and the gaming machine 10 or wager-input data communicated to the handheld gaming machine 110. A multipoint gesture input is received (604) via the multipoint sensing device 300, and the input is converted into data representing the multipoint gesture (such as coordinates of the points touched, the magnitude of the pressure applied to the points touched, the direction, velocity, and acceleration of a multipoint gesture), which is compared against known multipoint gesture inputs (606) to determine whether a match is found (608). For example, a known multipoint gesture input may include a set of coordinates relative to the multipoint sensing device 300 representing multiple points touched simultaneously. Another known multipoint gesture input may include a circular gesture having a predetermined radius or range of radii.

If a match is found (608), the method (600) includes determining a player input corresponding to the multipoint gesture input (610). The player input may be, for example, a selection of multiple cards, an indication of a payline to be selected, an indication of the number of wagers per payline, an indication of a bonus award amount, and the like. Then, the wagering-game function associated with the player input is executed (612). Examples of wagering-game functions are provided herein, including without limitation selecting a payline, increasing or decreasing an amount to wager per payline, increasing or decreasing a potential bonus award, selecting a bonus award amount, selecting numbers in a keno-type or roulette-type wagering game, requesting a hold for one or more cards, inputting a wager amount, selecting a wager amount, selection of number of reels, selection of cards, an instruction to deal another card, a request to be dealt another card, a request to not be dealt another card, a cash-out request, and the like.

The next series of illustrations, FIG. 7*a* to FIG. 11, depict various multipoint gestures that cause a wagering-game function to be carried out. Generally, in various embodiments of the present invention, when a point or gesture is sensed by the multipoint sensing device 300, a graphic is correlated with the touch point or gesture. The correlation may be proximate the touch point or gesture such that the graphic is displayed proximate the touch point or gesture, or the correlation may be distal the touch point or gesture such as when the player touches an non-selectable area relative to the display 14, 16 and a graphic is displayed somewhere that is not proximate the touch point or gesture. In both embodiments, the graphic is correlated with the touch point or gesture.

Figure 7A:
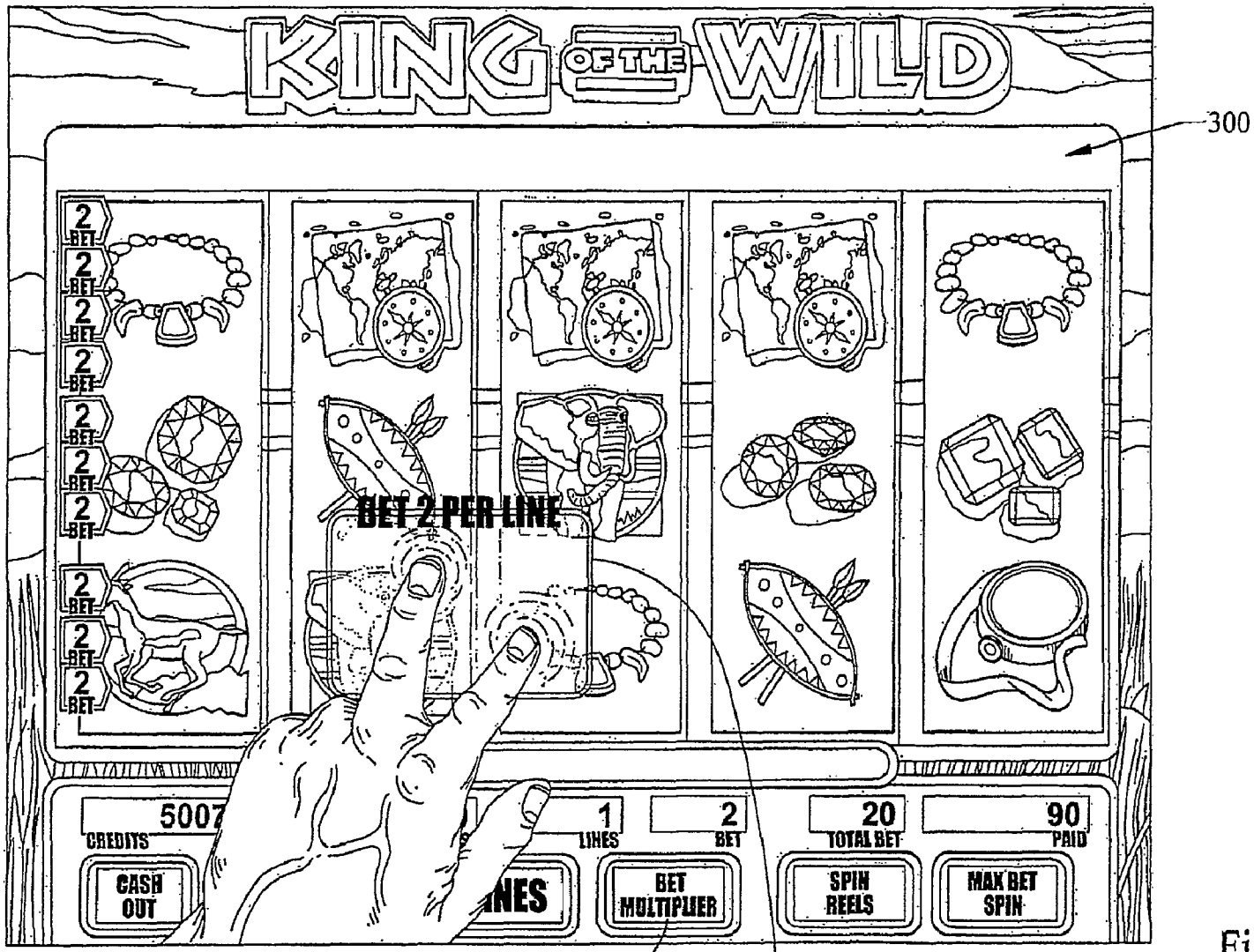
FIG. 7*a* is an illustration of a two-bet-per-payline selection by touching two points simultaneously on a multipoint sensing device.

In FIG. 7*a*, a player touches the multipoint sensing device 300 with at two points simultaneously with two fingers. The simultaneous touching of two fingers causes the gaming machine 10, 110 to carry out the wagering-game function of increasing the player's wager to two bets per payline. The player can also increase the wager amount by touching or pushing a virtual or physical bet multiplier button 702 on the gaming machine 10, 110. However, the present invention allows the player to quickly indicate two bets per payline by simultaneously touching any two points on the multipoint sensing device 300. A graphic 704 can be displayed on the display 14, 16 around or proximate the points touched to provide synchronized visual feedback to the player that the player's instruction to increase the wager has been received and understood by the gaming machine 10, 110.

The graphic 704 may represent a "betting zone" within which the player can touch with multiple fingers to indicate the amount to be wagered per payline. An audio sound may also accompany the sensing of two touched points to provide further audible feedback to the player. For example, an audio sound that is repeated twice can provide audible feedback that the player indicated "two" as opposed to three, for example, bets per payline.

In an embodiment, the betting zone 704 represents a player selectable area on the display 14, 16 such that when the player touches inside that area, a wagering-game function is carried out. In other embodiments, if a player touches an area that is not player selectable, such as outside of the betting zone 704, a graphic or graphics correlated with the touched point or points are displayed. For example, a cross-hair can be displayed proximate the point(s) of contact, or a red "X" can be displayed anywhere on the display 14, 16 that is correlated with the touched point or points to inform the player that a non-selectable area was touched. Touching a non-selectable area would not result in a wagering-game function to be carried out.

Figure 7B:
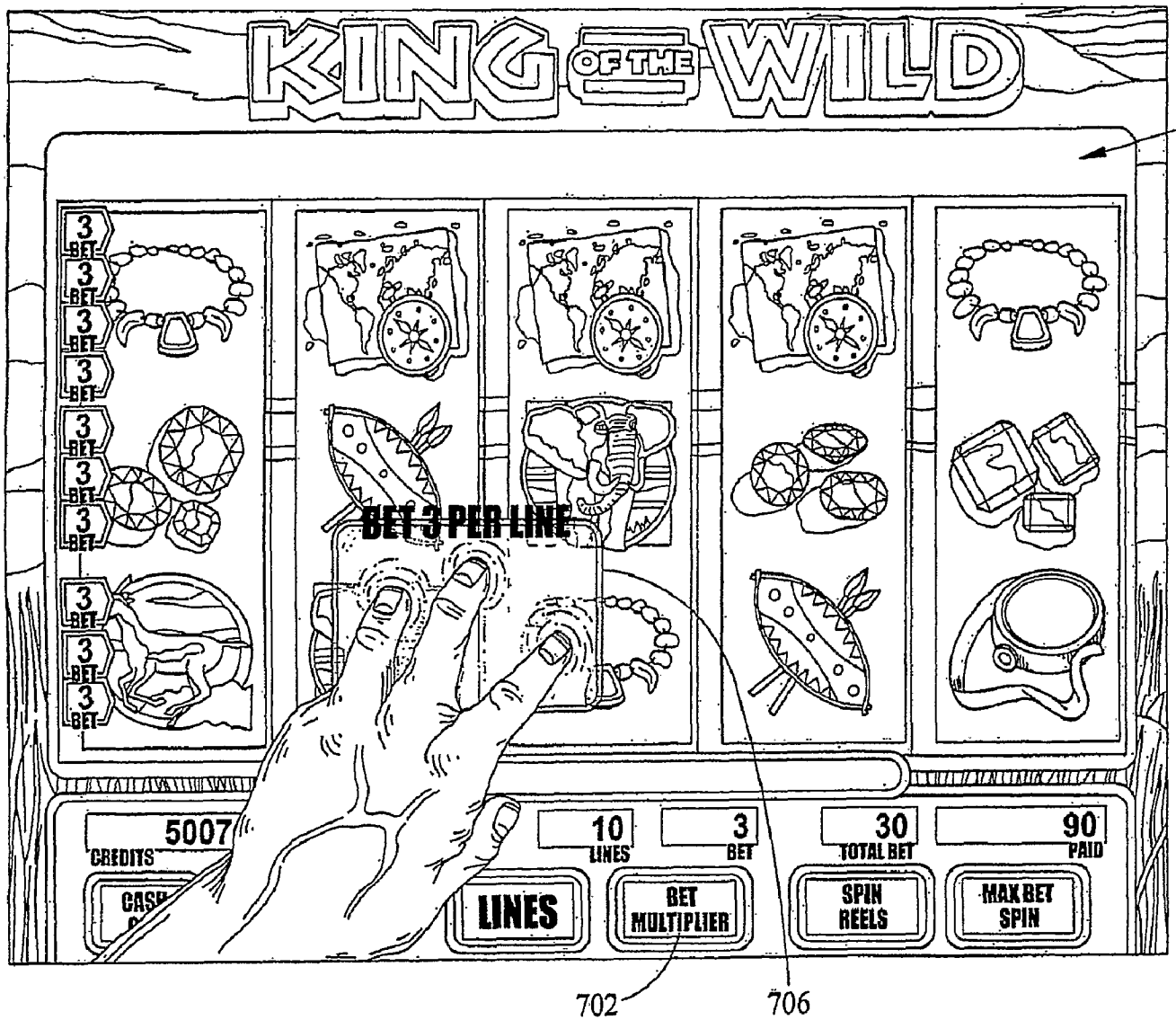
FIG. 7*b* is an illustration of a three-bet-per-payline selection by touching three points simultaneously on a multipoint sensing device.

FIG. 7*b* illustrates how a three-bet-per-payline request by the player is detected. The player touches simultaneously any three points on the multipoint sensing device 300 to cause the wagering-game function of increasing the player's wager to three bets per payline. A graphic 706 is optionally displayed on the display 14, 16 around the points touched to provide synchronized visual confirmation that the player's request has been received and understood. A significant advantage of the multipoint sensing technology according to the present invention is that the player can very quickly indicate how much to wager per payline by touching with the appropriate number of fingers simultaneously, rather than having to touch or depress a bet multiplier button 702 multiple times. A synchronized audio sound may accompany the graphic 706, such as a sound that is repeated three times to indicate a three-bets-per-payline request was received from the player. Another advantage is that the multipoint sensing technology fosters enhanced player interaction with the wagering game. By using multiple fingers and/or both hands to interact with wagering-game elements relative to the multipoint sensing device 300 increases the sense of player participation and excitement. In addition, the multipoint gesture is "intuitive" in that two fingers are required for a two-bet-per-payline request and three fingers are required for a three-bet-per-payline request. Once the player is instructed as to how to multiply the wager, such as by an introductory instructional screen or in a message window provided discretely on the display 14, 16, the player can quickly learn how to interact with the gaming machine 10, 110 using his fingers and hands.

If the player makes a mistake by indicating three-bets-per-payline, the player can simply re-touch the multipoint sensing device 300 with two fingers simultaneously to indicate two-bets-per-payline. A corresponding graphic and optional audio sound provide graphical and audible feedback confirmation synchronized with the multipoint gesture. The synchronization of a graphic with the multipoint gesture is an important aspect to the present invention, as the graphic provides a visual feedback to the player that the multipoint gesture is being sensed properly. Thus, as a gesture moves relative to the multipoint sensing device 300, a corresponding graphic, such as a residual or semi-persistent trail or glow, is synchronized with the movement.

Figure 7C:
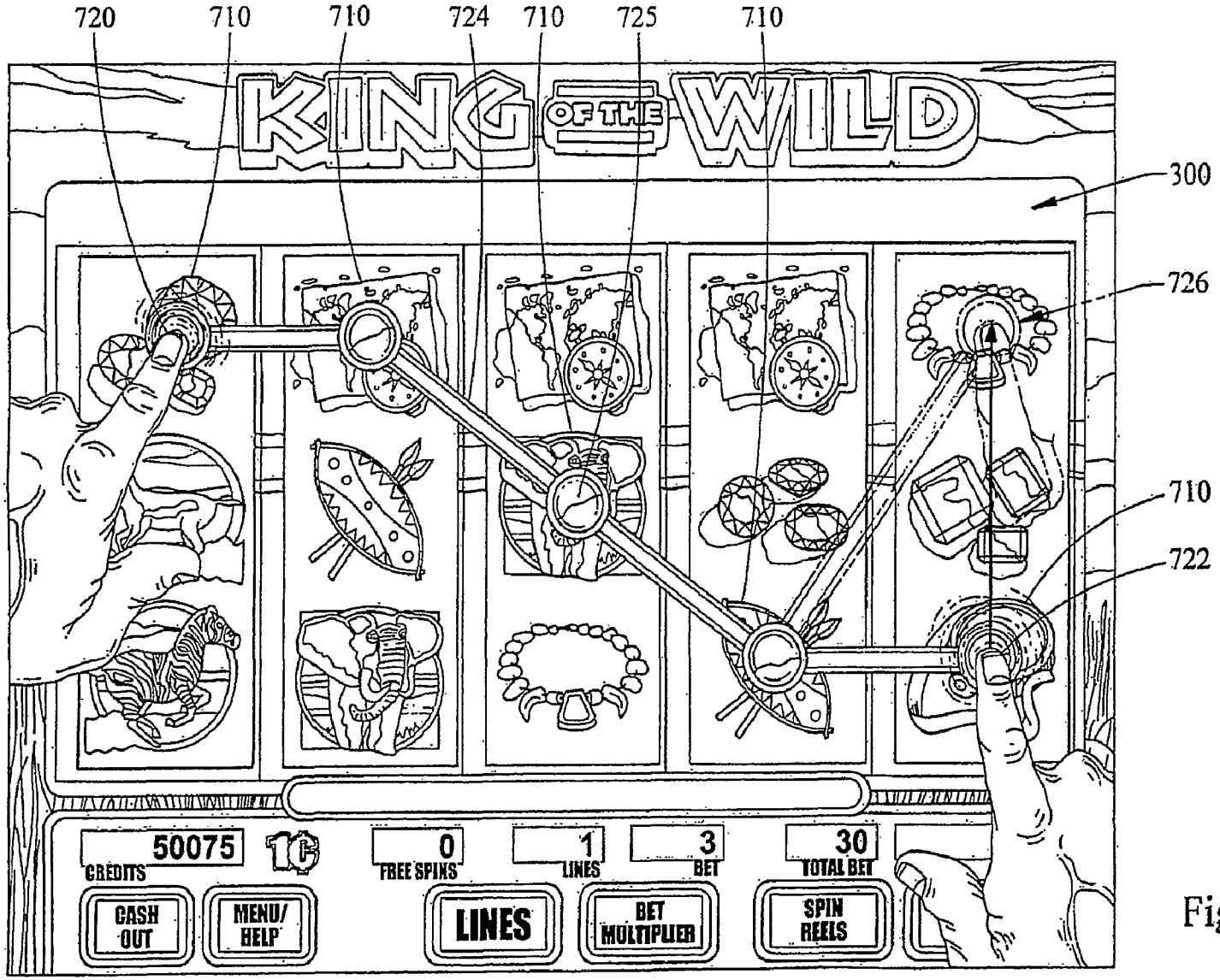
FIG. 7*c* is an illustration of a selection of a payline by touching two points simultaneously on a multipoint sensing device.

FIG. 7*c* illustrates a multipoint gesture that causes the gaming machine 10, 110 to carry out the wagering-game function of selecting a payline. A slot-type wagering game is shown with five reels and multiple symbols 710 arranged relative to each reel. Two points 720, 722 are touched on the multipoint sensing device 300 simultaneously by the player. A payline 724 is formed between the two touched points 720, 722, and by releasing the two points 720, 724, that payline 724 is selected. The appearance of the payline 724 provides graphical feedback to the player of the payline selected for the wagering game. Of course, the player can select a different payline by touching two other points simultaneously. An optional audio sound can be played to provide audible feedback confirmation of the selected payline. An advantage to the payline-selection scheme shown in FIG. 7*c* is that the player can quickly and intuitively select a payline. This rapid selection speeds up game play, resulting in a higher wager-input throughput for the gaming establishment, and provides valuable interaction to the player who feels more invested and interested in playing the wagering game. In addition, the display 14, 16 presented to the player can be less cluttered by, for example, payline selection buttons running along the sides of the reel sets, drawing more visual attention to the wagering-game symbols 710 and other aspects of the wagering game. The payline-selection function can be combined with the wager-multiplier function of the previous FIGS. 7*a* or 7*b*. In other words, a player can (in any order) select one or more paylines in accordance with FIG. 7*c* and increase a wager amount per payline in accordance with FIG. 7*a* or 7*b*. It should be readily appreciated the rapid ease with which the present invention enables such wagering-game functions to be carried out.

To select different paylines, the player can touch point 720, and then touch point 722 repeatedly while holding touch point 720. In other words, the first touch at point 722 may select payline 724, but a second touch at point 722 (while still touching point 720) will select a different payline. Alternately, the player can drag his finger from point 722 to point 726 (while still touching point 720) in the direction of the arrow shown to cause a different payline to be selected. When dragging the finger relative to the display 14, 16, a motion trail can be displayed proximate the points of contact, the motion trail providing visual feedback to the player that the motion is being sensed. Or, the player can release point 722 (while still touching point 720) and touch point 725 and drag that point 725 up or down to select a different payline. When the player ultimately releases both fingers, the associated payline is selected, and the corresponding wagering-game function is carried out by the gaming machine 10, 110. In general, the player can manipulate both hands to quickly select a payline, and as new points or gestures are touched, the appropriate payline is redrawn dynamically.

Figure 8A:
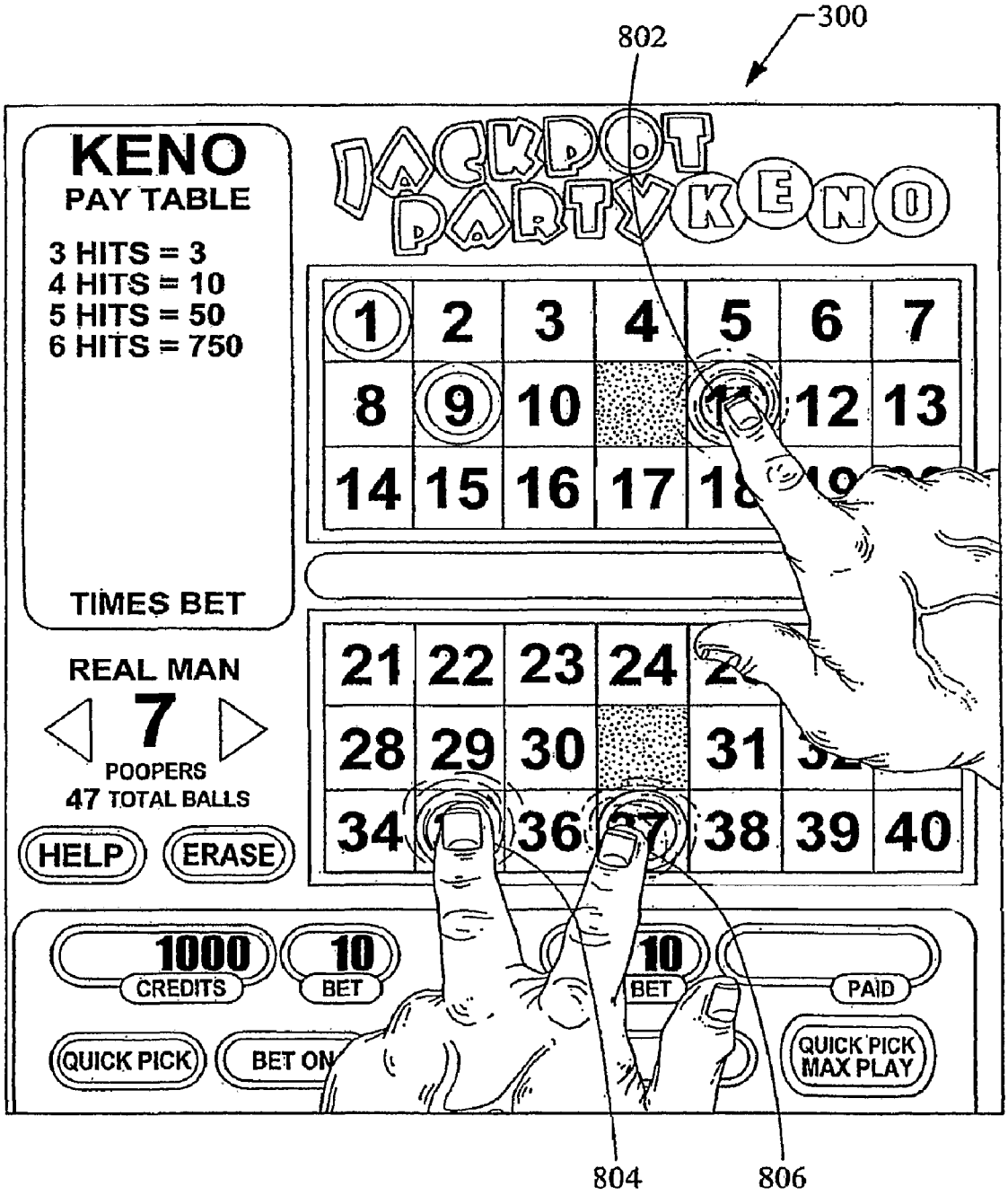
FIG. 8*a* is an illustration of a selection of multiple keno numbers by touching multiple points simultaneously on a multipoint sensing device.

FIG. 8*a* illustrates multiple selection of keno numbers for a keno-type wagering game. The same principles apply to a roulette-type wagering game, where the numbers selected are numbers on a roulette wheel. Here, the player touches three points 802, 804, 806 simultaneously on the multipoint sensing device 300 to select three keno numbers, 11, 35, and 37, respectively. This bimanual selection also requires the use of multiple fingers on each hand. Now, the player need not select each number in seriatim but rather can quickly. select using both hands and multiple fingers on each hand multiple numbers simultaneously. It has been found that players actually select more numbers when they can select multiple numbers simultaneously, and are less likely to deselect numbers once they are selected because they grow accustomed to a more rapid game play.

Figure 8B:
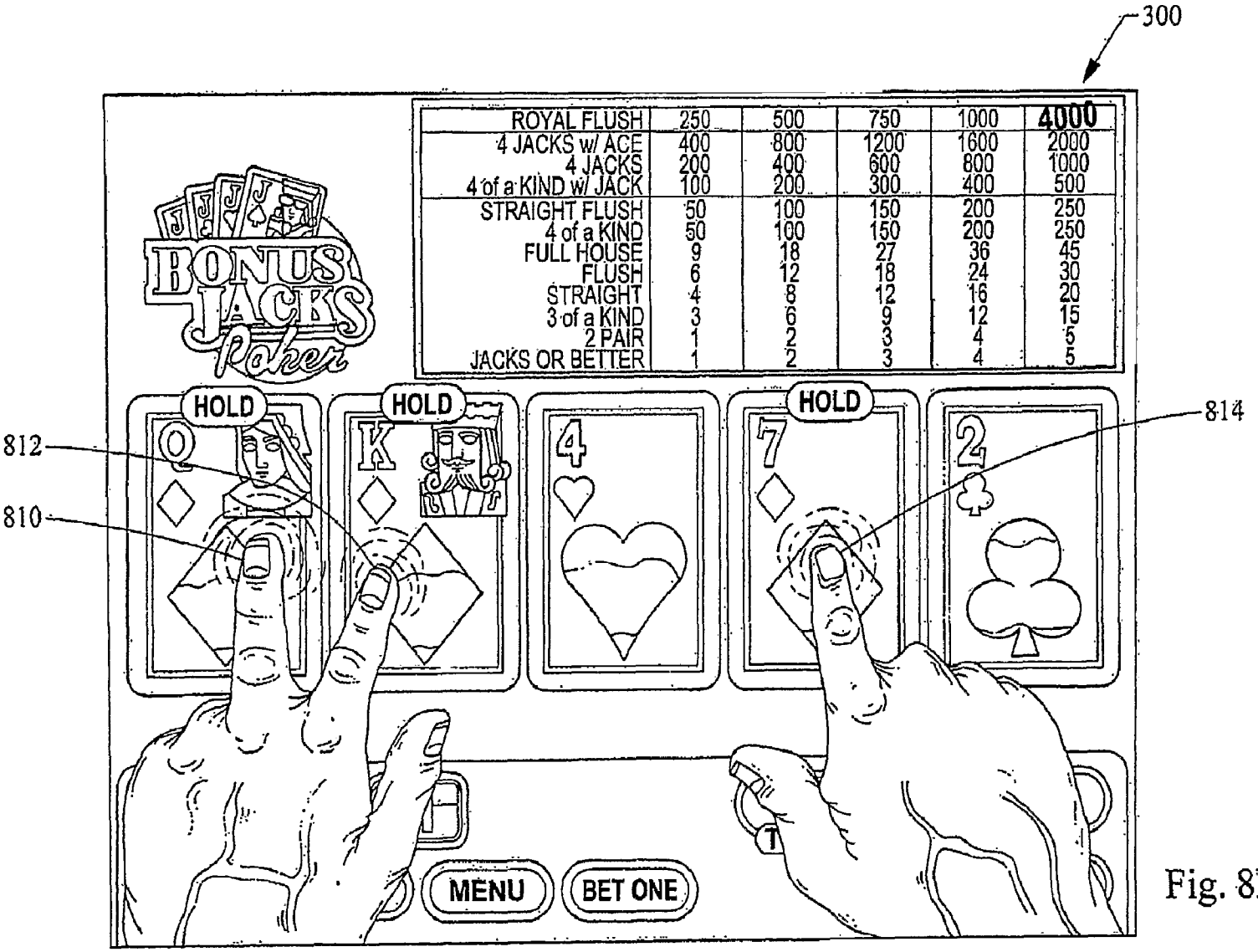
FIG. 8*b* is an illustration of a request to hold multiple cards by touching multiple points simultaneously on a multipoint sensing device.

FIG. 8*b* illustrates multiple selection of cards in a poker-type wagering game. Multiple points 810, 812, 814 are touched simultaneously on the multipoint sensing device 300 to cause the wagering-game function of holding a poker card to be carried out. Each card "touched" indicates a hold request by the player. In the illustrated embodiment, three hold requests have been made by the player. As with the other embodiments, the touch scheme is intuitive—to hold multiple cards, the player simply touches and "holds" the desired cards. Graphical elements such as the illustrated HOLD images can be displayed over the selected cards to provide feedback confirmation to the player that the requested cards have been selected by the gaming machine 10, 110.

Figure 9B:
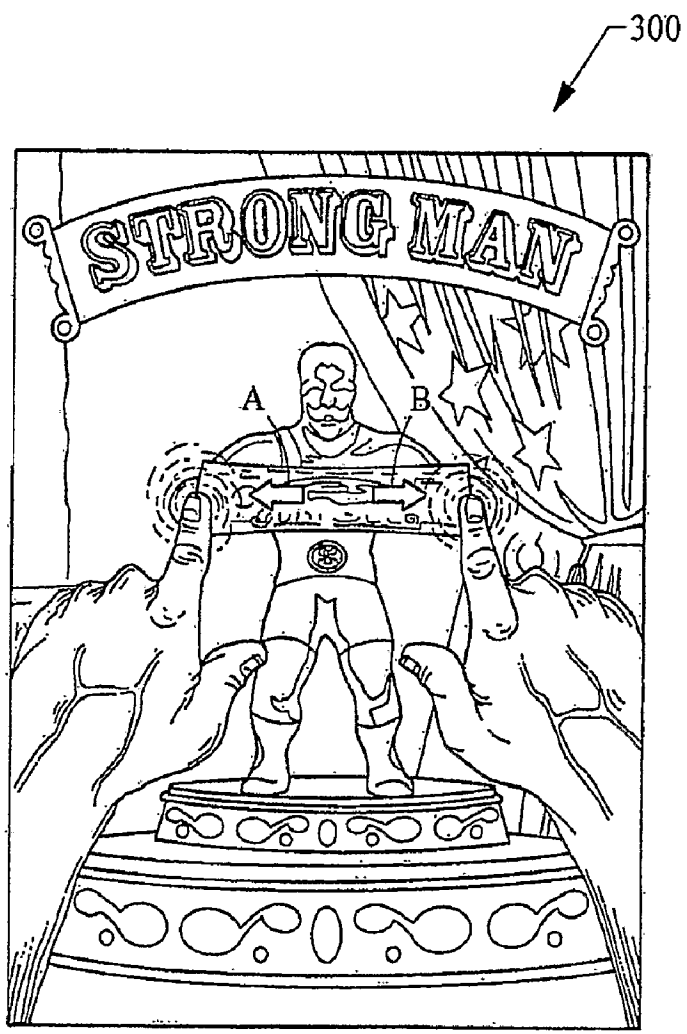
FIGS. 9*a* and 9*b* illustrate how a bonus award can be increased by a multipoint gesture on the multipoint sensing device in which two fingers are moved in opposite directions while maintaining contact with the multipoint sensing device.
Figure 9A:
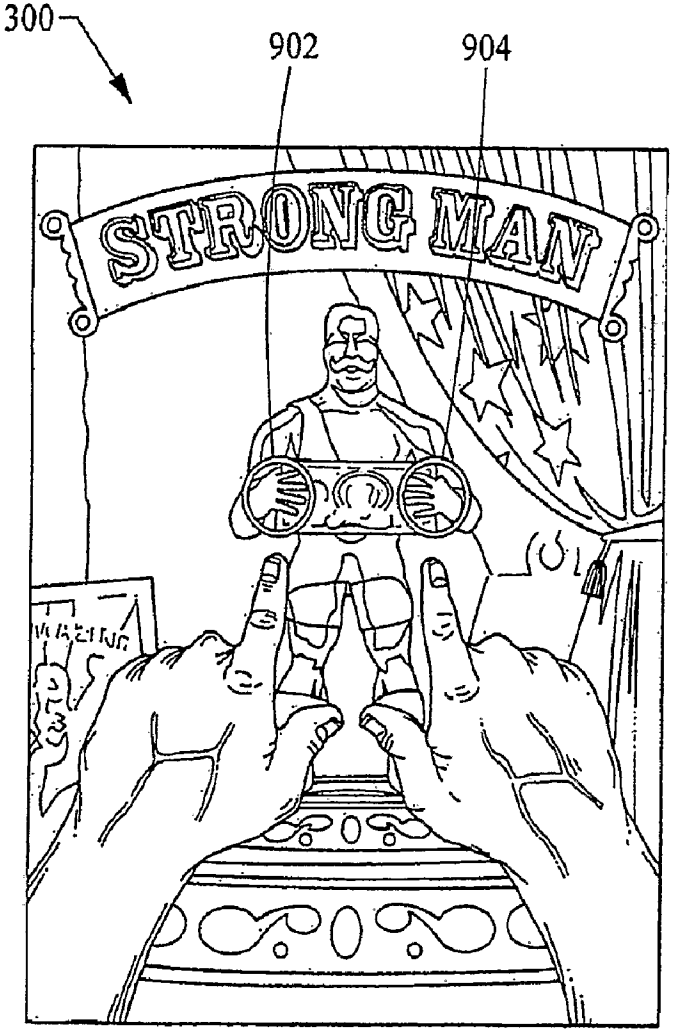

FIGS. 9*a* and 9*b* illustrate a multipoint gesture input that causes a wagering-game function of increasing a potential bonus award to be carried out during a bonus game of the wagering game. It should be understood that the multipoint gesture aspects herein apply equally to a primary wagering game and to a bonus game. The player touches two points 902, 904 simultaneously, and then drags his fingers apart in directions A, B to "stretch" the amount of the bonus award as shown in FIG. 9*b*. The distance the fingers are dragged represents the amount of the increase in potential bonus award. Graphical feedback in the form of a stretching currency bill provides visual feedback confirmation to the player that the bonus award is being increased. A motion trail may also accompany the moving finger, as discussed above in connection with FIG. 7*c*. An audio sound such as a stretching sound may accompany the multipoint gesture to provide audible feedback confirmation. Again, an advantage to the multipoint gesture aspect of increasing a potential bonus award is that the player interacts more with the wagering game. By dragging the fingers using a chording gesture to increase the bonus award amount, the player feels an enhanced sense of investment and interaction with the wagering game, which reduces player boredom and increases player excitement thereby prolonging game play. The stretching gesture is intuitive—the player uses a gesture that would mimic the same gesture used to stretch a physical stretchable object.

Figure 10A:
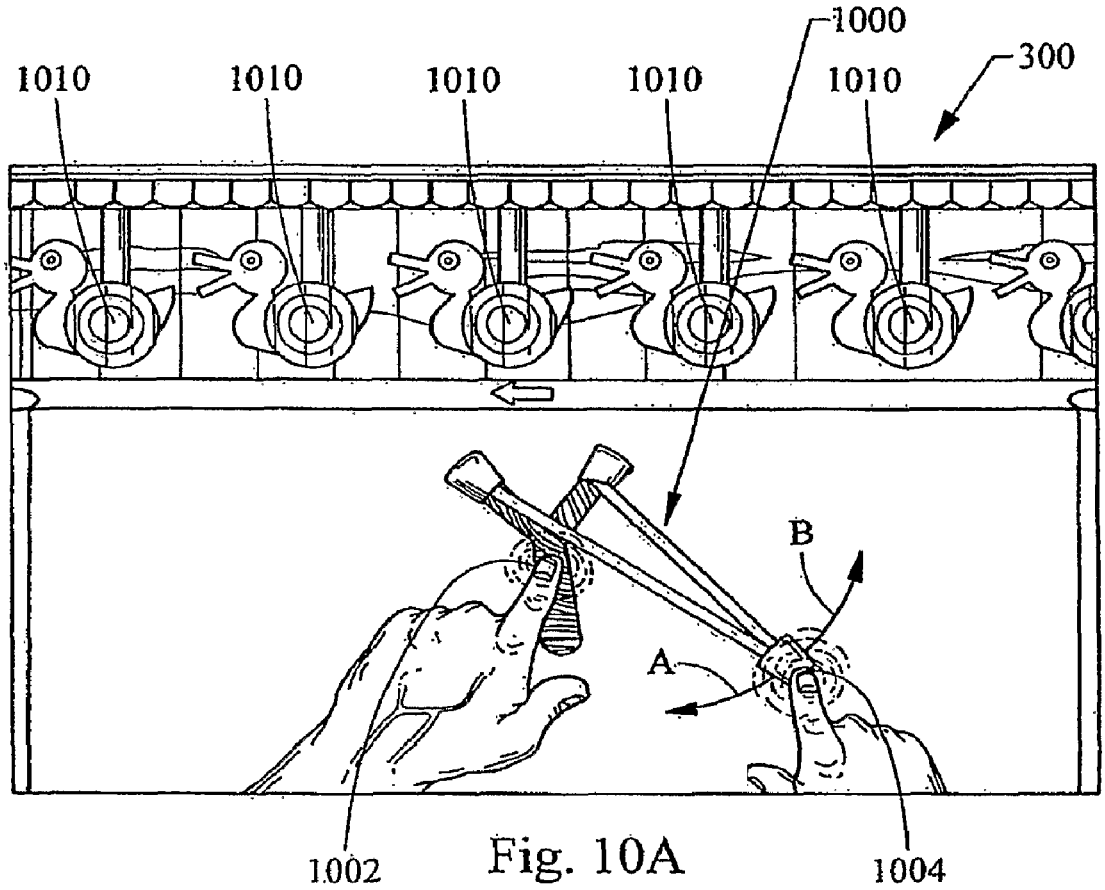
FIGS. 10*a* and 10*b* illustrate how a bonus award amount can be revealed by a multipoint gesture in which one finger is touches a stationary object while the other finger uses gestures to aim a movable object that acts upon another object to reveal a bonus award amount.
Figure 10B:
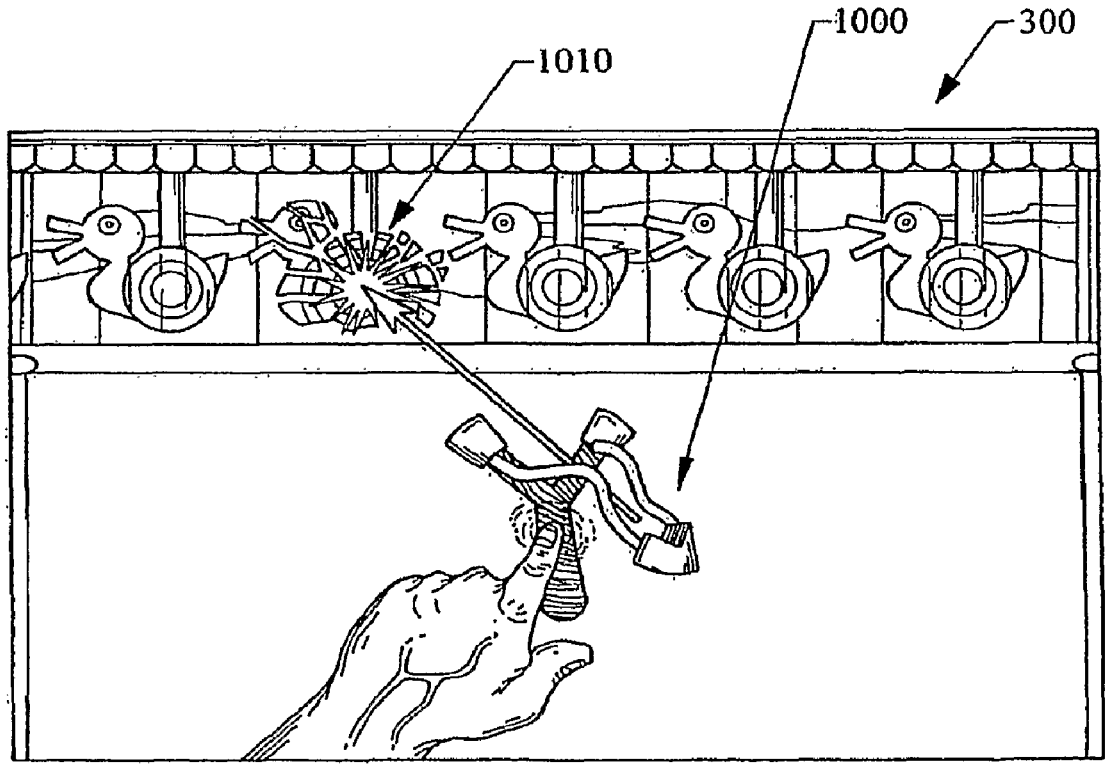

FIGS. 10*a* and 10*b* illustrate a multipoint gesture that causes a wagering-game function of selecting a bonus award amount. A slingshot 1000 is displayed on the display 14, 16 and the player touches the slingshot 1000 at point 1002 with one finger while simultaneously touching the pocket 1004 attached to a virtual band. The pocket holds a virtual projectile, which is aimed at various moving targets 1010, each target representing a hidden bonus award amount. The player holds point 1002 while simultaneously gesturing with point 1004 in directions A, B to "aim" the projectile at one of the moving targets 1010. Note that the gesture depicted in FIGS. 10*a* and 10*b* are directional in that a direction is calculated based on the distance and relative coordinate positions of the two points 1002, 1004. A velocity and acceleration can also be calculated, and environmental effects such as wind or gravity may be simulated to affect the virtual projectile as it leaves the pocket 1004. As the player moves the point 1004 around the multipoint sensing device 300, the slingshot 1000 is redrawn to track the movement of the band and pocket. This animation provides visual feedback and confirmation to the player that the gesture is being sensed. A motion trail proximate the finger can also be displayed, which tracks the movement of the player's finger relative to the display 14, 16. The player can also move the position of the slingshot handle 1002 to orient it in an optimal position for hitting one of the moving targets 1010. Sound effects can also provide audible feedback confirmation of certain gestures, such as stretching the band or moving the pocket 1004 relative to the handle 1002. Vibrational feedback can be supplied by the haptic device 310, such as by increasing the frequency of vibrations as the slingshot 1000 is stretched to simulate the increasingly taut forces applied to the slingshot band.

Any of the gesture aspects of the present invention may include a synchronized trail or animation for graphical feedback, akin to the trail that can be displayed as a mouse is dragged across a video display. The animated trail, synchronized with the direction of the gesture movement, provides assurance to the player that the gaming machine 10, 110 is properly interpreting the player's input. Further, any of the gesture aspects of the present invention may also be synchronized with a corresponding haptic feedback from the haptic device 310.

Pressure sensing techniques described herein can be employed here to require the player to apply increasing pressure on point 1002 as point 1004 is moved further away from point 1002, to simulate the increased pressure caused by the stretching forces created by the slingshot band. If the player does not apply a sufficient pressure to the point 1002, the slingshot can be made to appear to fly out of the player's hand along with an informational message along the lines of, "Whoops, you need to hold on tightly to the slingshot as you stretch the band." In this manner, an actual slingshot motion can be simulated, enhancing the player's experience and creating a sense that the player is highly interacting with the wagering game. High levels of excitement and interest and generating feelings of interaction and engagement in the player are very important aspects to successful wagering games.

To release the projectile, the player lifts his finger from the point 1004, and the projectile is launched from the slingshot 1000 in the direction of the arrow and hits one of the moving targets 1010, whereupon the bonus award amount is revealed to the player. The wagering-game function being carried out here is a selection of a bonus award amount, but in FIGS. 10*a* and 10*b*, it is carried out in a manner that is fun, engaging, interactive, and intuitive to the player. Some level of player "skill" is involved in which the player must aim and estimate the direction and trajectory of the projectile, using both fingers to determine the direction and velocity of the shot. Note that the bonus award amount may be selected when the player's fingers are oriented to launch the projectile in a certain direction, or the bonus award amount may also require the player to also orient the fingers to launch the projectile with an appropriate velocity. If the player misses the direction or fails to launch the projectile with the appropriate velocity, the bonus award amount may be denied to the player.

Similar gestures can be utilized to fly a plane or helicopter or to drive a car or a boat to accomplish an event related to the wagering game, such as eligibility for a bonus round. Multiple fingers or multiple hands are used as the flight or steering controls, with multipoint gestures controlling movement, speed, attitude, altitude, speed, acceleration, direction, gear, and the like.

Figure 11:
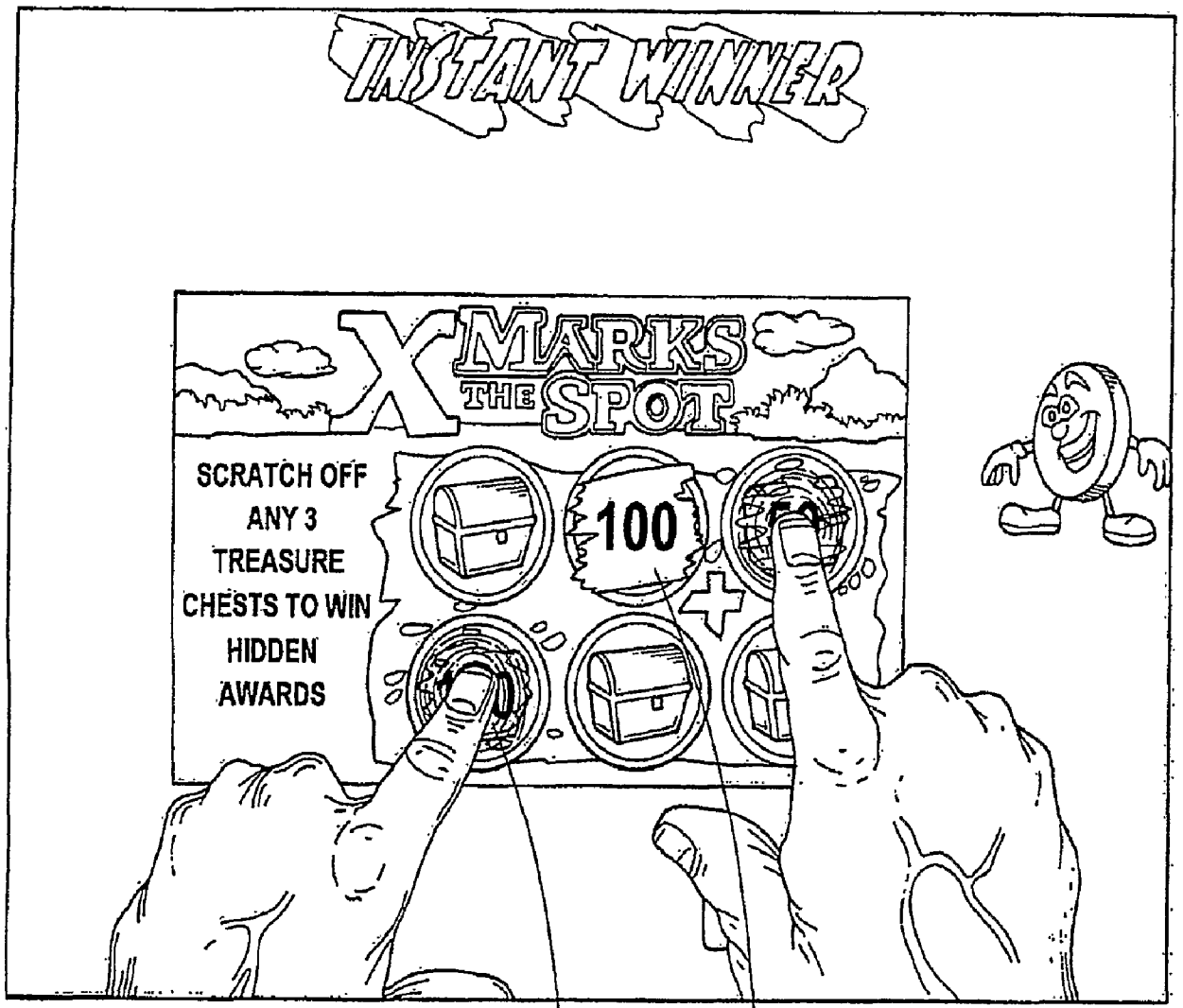
FIG. 11 is an illustration of a selection of a bonus award revealed by applying multiple scratching gestures to objects depicted on a virtual scratch card in which total bonus award amount is initially concealed until multiple objects are scratched off.

FIG. 11 is an illustration of a "scratch-and-win" scratch card displayed relative to the multipoint sensing device 300 in which multiple points corresponding to treasure chests 1102, 1104 are touched simultaneously to reveal hidden awards inside the treasure chests. The wagering-game function to be carried out is selecting bonus awards. The multipoint gesture can be a back-and-forth scratching motion as a player would make to scratch a physical scratch card to reveal hidden potential prizes. According to an aspect, the player would touch simultaneously multiple treasure chests initially, and then using a scratching gesture across one or more treasure chests to rub off the treasure chest, thereby revealing the bonus award amount. The haptic device 310 may simulate a scratching vibration to provide haptic feedback to the player as the player is making a scratching gesture on the virtual card.

The player can also use more than one finger to scratch off a symbol. By using, for example, two or three fingers, the player can "scratch off" more of the treasure chest 1102, 1104 than with one finger. In this respect, the multipoint sensing device 300 is operable detect the size of the area contacted, and based on the size detected, cause more of the hidden potential prize to be revealed.

The foregoing illustrations are but a few of numerous wagering-game functions that can be carried out in response to the detection of a multipoint gesture input on the multipoint sensing device 300. Any of the embodiments herein may be accompanied by a visual, tactile, and/or audible cue or feedback to provide confirmation of the multipoint gesture detected or to create a sensory interactive gaming environment. In addition, the multipoint gesture aspects of the present invention are equally applicable to a multi-player wagering game, in which multiple players touch the multipoint sensing device 300 to cause wagering-game functions to be carried out.

Each of these embodiments and obvious variations thereof is contemplated as falling within the spirit and scope of the claimed invention, which is set forth in the following claims.

What is claimed is:

1. A gaming machine comprising:

an input device for receiving a signal representing a wager associated with a wagering game;

a video display for displaying the wagering game and a randomly selected outcome thereof;

a multipoint sensing device positioned adjacent to the video display and having an output for outputting multipoint input data indicative of a multipoint input relative to the video display such that the multipoint input corresponds to at least two distinct contact points sensed simultaneously by the multipoint sensing device, wherein the multipoint input includes a gesture made by at least one of the contact points; and a controller coupled to the multipoint sensing device and the video display, the controller being programmed to:

determine a distance between the at least two distinct contact points;

cause the video display to display a graphic that appears to move at a velocity related to the distance and in a direction related to the positions of the at least two distinct contact points, wherein the graphic has more than one degree of freedom of movement; and execute a predetermined wagering-game function that causes an award to be revealed on the video display in a manner that appears to have been influenced by the graphic, the award being determined by the randomly selected outcome.

2. The gaming machine of claim 1, wherein the multipoint sensing device includes a frustrated total internal reflection (FTIR) device having a transparent substrate, the video display including a video projector for displaying images relative to the transparent substrate and a video camera for capturing scattered light at multiple points of contact on the transparent pane.

3. The gaming machine of claim 1, wherein the multipoint sensing device is a multipoint touch screen that includes a plurality of capacitive electrodes arrayed relative to a transparent substrate, the multipoint touch screen overlaying at least a portion of the display.

4. The gaming machine of claim 1, wherein the video display is of a liquid crystal type.

5. The gaming machine of claim 1, wherein the gaming machine is a handheld gaming machine.

6. The gaming machine of claim 1, wherein the multipoint input data is indicative of any one or more of a direction, a size, an acceleration, and a pressure of the gesture sensed by the multipoint sensing device.

7. The gaming machine of claim 1, wherein the wagering game is a bonus game, and wherein the award is a bonus award.

8. The gaming machine of claim 1, wherein the predetermined wagering-game function includes a selection of a payline.

9. The gaming machine of claim 1, wherein the predetermined wagering-game function includes an amount to wager per payline.

10. The gaming machine of claim 1, wherein the predetermined wagering-game function includes a selection of the award.

11. The gaming machine of claim 1, wherein the controller is further programmed to cause the video display to display a motion trail with the multipoint input sensed by the multipoint sensing device as at least one contact point is being moved relative to the multipoint sensing device to form the gesture.

12. The gaming machine of claim 1, wherein the multipoint input corresponds to a point that is touched relative to the multipoint sensing device and held there while touching another point, dragging that other point relative to the multipoint sensing device, and releasing that other point thereby causing the graphic to appear to move.

13. The gaming machine of claim 12, wherein the award is revealed to the player as a function of the respective coordinates of the touched point and the released point.

14. The gaming machine of claim 1, wherein the multipoint input data is indicative of a pressure applied to the other of the contact points while the at least one contact point is moved relative to the multipoint sensing device.

15. The gaming machine of claim 14, wherein the controller is further programmed to determine whether the pressure is sufficiently applied to cause the graphic to be made to move.

16. The gaming machine of claim 1, wherein the graphic is a projectile that is launched at a plurality of targets, the controller being further programmed to cause the projectile to appear to hit one of the plurality of targets corresponding to the award to be revealed, wherein the award is determined before the projectile is caused to appear to move.

17. The gaming machine of claim 1, wherein the graphic has no influence of the randomly determined outcome.

18. A method of conducting a wagering game on a gaming machine, the method comprising:

receiving a signal representing a wager associated with a wagering game;

responsive to the receiving, causing a randomly selected outcome of the wagering game to be determined;

identifying at least one multipoint gesture based on data received from a multipoint sensing device, the multipoint gesture being formed from at least one of at least two distinct contact points sensed simultaneously by the multipoint sensing device;

determining a distance between the at least two distinct contact points;

displaying on a video display of the gaming machine a graphic that appears to move at a velocity as a function of the distance and in a direction as a function of the relative positions of the at least two distinct contact points wherein the graphic has more than one degree of freedom of movement; and causing an award to be revealed on the video display in a manner that appears to have been influenced by the graphic, the award being determined by the randomly selected outcome.

19. The method of claim 18, further comprising causing a controller of the gaming machine to determine, responsive to the identifying, a wagering-game function and to execute the wagering-game function.

20. The method of claim 18, further comprising comparing the data with data representing a wagering-game function, the modifying including executing the wagering-game function responsive to the comparing.

21. The method of claim 18, wherein the at least one multipoint gesture includes at least two gestures moved simultaneously relative to the multipoint sensing device and having two distinct initial touch points.

22. The method of claim 18, wherein the at least one multipoint gesture includes at least a first touch point held relative to the multipoint sensing device while simultaneously at least a second touch point, distinct from the first touch point, is gestured relative to the multipoint sensing device.

23. The method of claim 18, wherein the displaying further comprises displaying an animation synchronized with the at least one multipoint gesture sensed by the multipoint sensing device.

24. The method of claim 18, further comprising determining any one or more of a direction, size, acceleration, and pressure associated with the at least one multipoint gesture, and responsive thereto, causing a wagering-game function to be executed.

25. The method of claim 18, wherein the at least one multipoint gesture includes a second multipoint gesture, the method further comprising associating, responsive to the identifying, a selection of a payline with the second multipoint gesture.

26. The method of claim 18, wherein the at least one multipoint gesture includes a second multipoint gesture, the method further comprising associating, responsive to the identifying, a number of wagers per payline with the second multipoint gesture.

27. The method of claim 18, further comprising associating, responsive to the identifying, a selection of the award with the at least one multipoint gesture.

28. A non-transitory computer readable storage medium encoded with instructions for directing a handheld gaming machine to perform the method of claim 18.

29. The method of claim 18, wherein the data is indicative of a pressure applied to a first of the contact points while the other of the contact points is moved relative to the multipoint sensing device.

30. The method of claim 29, further comprising determining whether the pressure is sufficiently applied to cause the graphic to be made to move.

31. The method of claim 18, wherein the graphic is a projectile that is launched at a plurality of targets, the method further comprising causing the projectile to appear to hit one of the plurality of targets corresponding to the award to be revealed, wherein the award is determined before the projectile is caused to appear to move.

32. The method of claim 18, wherein the multipoint gesture has no influence of the randomly determined outcome.

33. A method of conducting a wagering game on a gaming machine, the method comprising:

receiving a signal indicative of a wager input for a wagering game;

determining a randomly selected outcome of the wagering game having an associated award;

responsive to determining the randomly selected outcome, receiving data from a multipoint sensing device indicative of at least one multipoint gesture, the multipoint gesture including at least two points simultaneously touched relative to the multipoint sensing device;

determining a distance between the at least two points;

displaying on a video display of the gaming machine a graphic;

responsive to detecting that at least one of the two at least points is no longer being touched relative to the multipoint sensing device, causing the graphic to appear to move at a velocity and a direction, the velocity being related to the distance and the direction being related to the positions of the at least two points, wherein the graphic has more than one degree of freedom of movement, the graphic causing the award to be revealed on the video display, wherein the gesture has no influence on the randomly selected outcome that produced the award.

34. The method of claim 33, wherein the multipoint gesture includes at least one gesture originating at one of the at least two points.

35. The method of claim 33, wherein the graphic appears to interact with another graphic on the video display to cause the award to be revealed.

36. The method of claim 33, wherein the data is indicative of a pressure applied to a first of the contact points.

37. The method of claim 36, further comprising determining whether the pressure is sufficiently applied to influence the graphic.

38. The method of claim 33, wherein the wagering game is a bonus game and wherein the award is a bonus award.

* * * * *